US007255237B2

(12) United States Patent
Stitchick et al.

(10) Patent No.: US 7,255,237 B2
(45) Date of Patent: Aug. 14, 2007

(54) MOUNTING UPRIGHT AND CLIP FOR ADJUSTABLE ORGANIZER SYSTEM

(75) Inventors: David M. Stitchick, Akron, OH (US); Anthony Marchetta, Broadview Heights, OH (US); Frazer Costa, Canton, OH (US); Sean M. O'Brien, Corvallis, OR (US)

(73) Assignee: Rubbermaid Incorporated, Fairlawn, OH (US)

( * ) Notice: Subject to any disclaimer, the term of this patent is extended or adjusted under 35 U.S.C. 154(b) by 59 days.

(21) Appl. No.: 10/886,812

(22) Filed: Jul. 7, 2004
(Under 37 CFR 1.47)

(65) Prior Publication Data

US 2005/0145588 A1 Jul. 7, 2005

Related U.S. Application Data

(63) Continuation-in-part of application No. 10/740,933, filed on Dec. 18, 2003.

(60) Provisional application No. 60/434,470, filed on Dec. 18, 2002.

(51) Int. Cl.
*A47F 5/08* (2006.01)

(52) U.S. Cl. ..... 211/106; 211/117; 248/327; 403/392; 403/300

(58) Field of Classification Search ..... 211/117, 211/118, 94.01, 94.02, 103, 113; 403/300, 403/292, 293, 298, 286, 316; 248/317, 327; 135/909

See application file for complete search history.

(56) References Cited

U.S. PATENT DOCUMENTS 303,474 A * 8/1884 Webb ..... 403/349
1,611,397 A * 12/1926 Wells ..... 211/70.1
2,622,834 A 12/1952 Sparring
2,827,254 A * 3/1958 Faber ..... 248/243
3,288,489 A * 11/1966 Jahn ..... 403/285
3,353,684 A 11/1967 Chesley
3,671,062 A * 6/1972 Ashworth ..... 403/292
3,698,329 A 10/1972 Diamond et al.
3,717,258 A 2/1973 McKinnon
3,915,097 A 10/1975 Young, Jr.
3,966,158 A 6/1976 Boundy
3,993,002 A 11/1976 Stroh
4,098,480 A 7/1978 Neumann
4,098,481 A * 7/1978 Johnson et al. ..... 248/243

(Continued)

OTHER PUBLICATIONS

International Preliminary Examination Report for PCT/US2003/040500, mailed Aug. 30, 2004.

(Continued)

*Primary Examiner*—Richard E. Chilcot, Jr.
*Assistant Examiner*—Jared W. Newton
(74) *Attorney, Agent, or Firm*—Marshall, Gerstein & Borun LLP

(57) ABSTRACT

A height adjustable upright for an adjustable organizer system has at least one first segment with a upper end configured to hang from a mounting rail and has a lower end. The upright also has at least one second segment with a pair of opposed ends, at least one of which being configured to connect end-to-end with the lower end of the first segment. A clip has a pair of opposed ends each configured to connect to the lower end of the first segment and to the one end of the at least one second segment to hang the second segment from the first segment.

19 Claims, 15 Drawing Sheets

U.S. PATENT DOCUMENTS 4,267,931 A 5/1981 Belotta
4,311,295 A 1/1982 Jamar, Jr.
4,335,973 A * 6/1982 Beck et al. ..... 403/300
4,406,374 A 9/1983 Yedor
4,516,874 A * 5/1985 Yang et al. ..... 403/313
4,553,523 A 11/1985 Stohrer, Jr.
D286,495 S 11/1986 Blomdahl
4,624,376 A 11/1986 Bertram
4,658,968 A 4/1987 Mastrodicasa
4,967,916 A * 11/1990 Handler et al. ..... 211/187
5,018,323 A * 5/1991 Clausen ..... 52/36.4
5,022,621 A 6/1991 Quest
5,050,832 A 9/1991 Lee et al.
5,110,080 A * 5/1992 Rieman ..... 248/225.11
5,127,762 A * 7/1992 Havlovitz ..... 403/298
5,144,780 A * 9/1992 Gieling et al. ..... 52/298
5,185,971 A 2/1993 Johnson, Jr.
D342,015 S 12/1993 Andrejew et al.
5,351,842 A 10/1994 Remmers
5,364,052 A 11/1994 De Gruttis
5,388,709 A 2/1995 Adams
5,421,646 A 6/1995 McNamara et al.
5,472,103 A 12/1995 Merl
5,538,213 A 7/1996 Brown
5,580,018 A 12/1996 Remmers
5,597,077 A 1/1997 Hartmann
5,738,019 A 4/1998 Parker
5,788,192 A 8/1998 Poole
5,875,895 A 3/1999 Dardashti
5,988,409 A 11/1999 Gusdorf et al.
6,024,333 A 2/2000 Raasch et al.
6,123,303 A 9/2000 Huang et al.
6,168,032 B1 1/2001 Merl
6,193,085 B1 2/2001 Nook et al.
6,227,506 B1 5/2001 Benedict
6,302,282 B1 10/2001 Gay et al.
6,315,134 B1 11/2001 Stuart
6,332,548 B1 12/2001 West et al.
6,663,201 B2 12/2003 Herron
6,685,037 B1 2/2004 Zadak
6,688,568 B1 2/2004 Moufflet et al.
6,726,035 B2 4/2004 Zadak
6,786,337 B2 * 9/2004 Klein et al. ..... 211/34
6,854,919 B2 * 2/2005 Neumann et al. ..... 403/326
6,932,225 B2 8/2005 Rowe et al.
6,969,036 B2 11/2005 Magnusson et al.
7,086,544 B1 8/2006 Doench
2002/0148796 A1 10/2002 Lin
2004/0007549 A1 * 1/2004 Klein et al. ..... 211/118
2005/0011420 A1 1/2005 Costa et al.
2005/0109720 A1 5/2005 Marchetta
2005/0109901 A1 5/2005 Stitchick et al.
2005/0145147 A1 7/2005 Costa et al.
2005/0145588 A1 7/2005 Stitchick et al.
2005/0150436 A1 7/2005 Marchetta et al.
2005/0150850 A1 7/2005 Stitchick et al.

OTHER PUBLICATIONS

International Search Report received in International (PCT) Application No. PCT/US2003/040500, mailed Oct. 5, 2004.

* cited by examiner

MOUNTING UPRIGHT AND CLIP FOR ADJUSTABLE ORGANIZER SYSTEM

RELATED APPLICATION DATA

This patent is a continuation-in-part of co-pending U.S. patent application Ser. No. 10/740,933, which was filed on Dec. 18, 2003, and which claims priority benefit of U.S. Provisional Application Ser. No. 60/434,470, which was filed on Dec. 18, 2002.

BACKGROUND OF THE INVENTION

1. Field of the Invention

The present disclosure is generally related to organizers for storage, and more particularly to an adjustable and reconfigurable organizer system and components for closets and the like.

2. Background of the Invention

Storage organizers, shelving units, and other storage systems are known in the art. Some are adjustable and can be arranged and configured in various ways prior to or during installation, within a storage space such as a closet. However, such systems typically cannot be readjusted or easily rearranged after installation. Further, only portions of these systems and organizers are adjustable, such as with respect to the number of shelves and/or shelf location.

Many examples of shelving systems are known to have vertical risers with multiple perforations provided therein. Once the risers are installed on a wall surface, shelf mounting brackets are mounted on the risers where a shelf is desired. The brackets are provided with hooks shaped for being received in the perforations. The hooks are typically L-shaped such that when received in the perforations, the hooks hold the bracket in the installed position. The brackets are typically designed for a shelf to either merely rest directly on the bracket top surface, or be fastened to the bracket.

Known storage organizers are not typically provided with different types of storage structures. A typical shelving unit comes with shelves and the hardware to mount shelves. Conventional storage organizers are not designed or configured to accommodate different types of storage structures and accessories in the same unit.

BRIEF DESCRIPTION OF THE DRAWINGS

Objects, features, and advantages of the present invention will become apparent upon reading the following description in conjunction with the drawing figures, in which.

DETAILED DESCRIPTION OF THE INVENTION

The present invention is directed to an organizer system that is highly versatile, adjustable, and reconfigurable either before, during, or after installation. The organizer system and its many variations disclosed herein provide a storage solution that is versatile and that can be individually customized for virtually any consumer's storage needs. The basic components of the disclosed organizer system provide shelving for storage. The basic system can also optionally accommodate clothes hanging. The shelf and optional clothes hanging rod structures can be arranged in a vast array of different configurations.

To add further versatility, the disclosed organizer also can accommodate myriad upgrades and storage accessories such as storage baskets, shoe storage shelves, shoe racks, and other storage accessories mountable to the basic system. The accessories can be mounted easily and directly to the basic system. The accessories can also be arranged in a wide variety of configurations as desired.

The organizer system and features disclosed herein solve many known problems with existing storage systems and units. The disclosed organizer system can be arranged to accommodate virtually any storage need, can be configured to fit in virtually any storage space that is at least large enough to install the minimum basic components, and can be customized utilizing the disclosed or other accessories to store virtually any item. The organizer system disclosed herein can be utilized in closets where it would be particularly well suited. However, the storage system can be mounted to a wall in virtually any space that can be used for storage, such as a shed, a laundry room, a basement corner, a garage, a bedroom, or the like.

Figure 1:
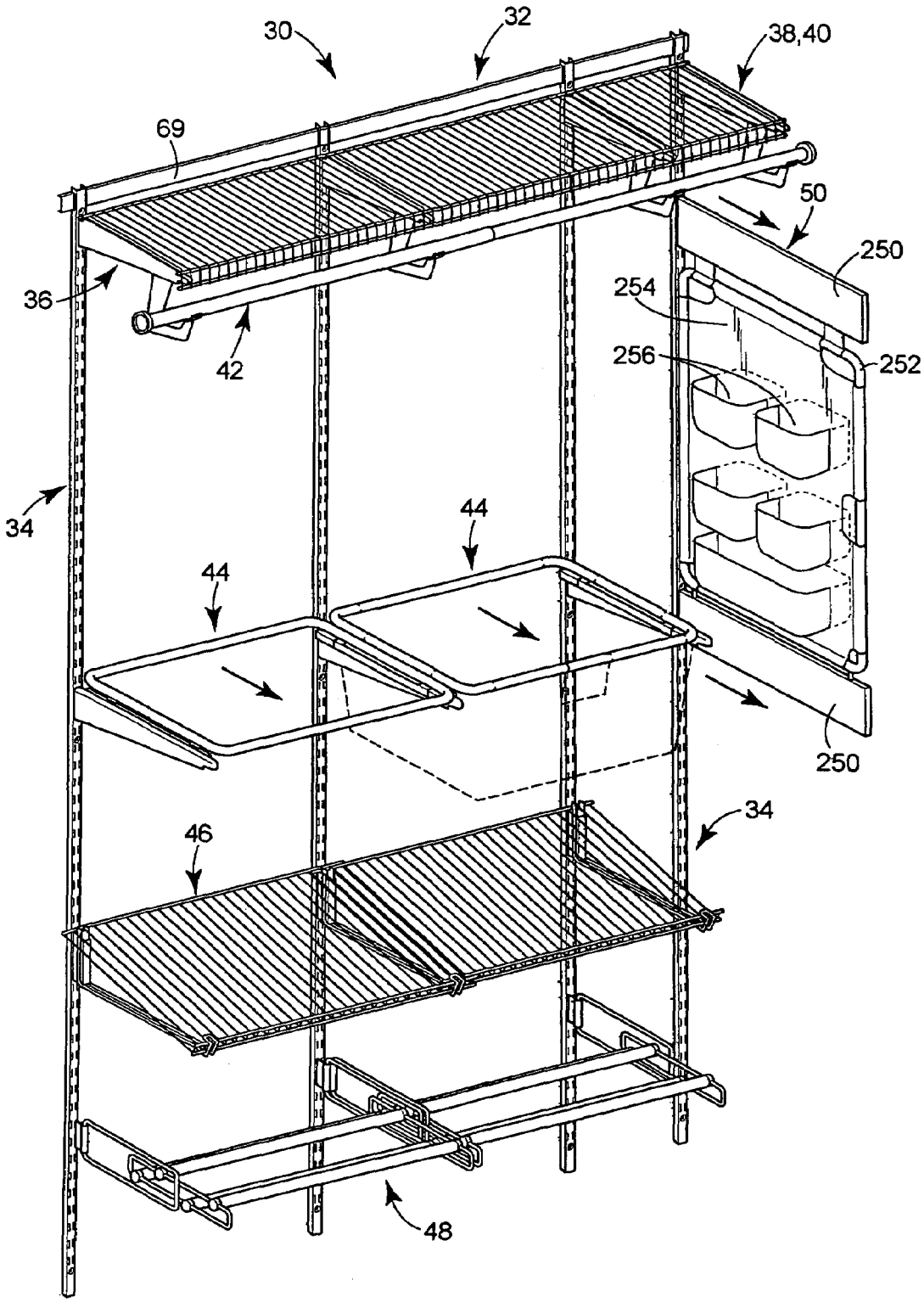
FIG. 1 shows a perspective view of an adjustable and reconfigurable closet organizer system constructed in accordance with the teachings of the present invention.

Referring now to the drawings, FIG. 1 generally illustrates a storage unit or organizer system 30 constructed in accordance with the teachings of the present invention. The organizer system 30 generally has a number of basic components including a length, or more accurately, a width adjustable, horizontal top rail assembly 32. As described below, the top rail assembly 32 can be expanded laterally from a minimum length or width of a single rail component to virtually any width desired utilizing two or more rail components. The system 30 also has a plurality of vertical uprights 34 mounted to and suspended from the top rail assembly 32. Two or more of the uprights can be mounted laterally spaced apart and extending downward from the top rail assembly 32. The uprights are adapted to support the various components of the system and can be adapted to extend over a variety or range of vertical heights or lengths as explained below. The disclosed organizer system 30 also includes a plurality of shelf mounting brackets 36 mounted to the uprights at desired locations. The system further has a plurality of wire shelves 38 and 40 supportable by the mounting brackets 36. The shelves 38 and 40 provide for width adjustment from a minimum width of a single shelf to virtually any width desired utilizing two or more of the shelves, also as discussed below.

In addition to the basic system components noted above, the disclosed organizer system 30 also can include a plurality of optional upgrades and accessories. The basic system can be adapted for mounting one or more optional clothes hanging rods 42. The system can be further adapted to accommodate one or more additional optional accessories such as storage baskets 44, shoe racks 46, shoe shelves 48, vertically oriented side sliders 50, or the like. Though not disclosed or described herein, any number of other accessories can be provided for use with and mounting directly on the basic system or indirectly via another optional accessory. Further, though the shelves are described as basic system components, an organizer system can also be configured using only one or more storage accessories mounted to the uprights with no shelves installed. Also, the system can include or be accompanied by optional upgrades, such as additional shelf mounting brackets, top rail assembly components, uprights, shelves, and the like. The optional accessories and upgrades can each be provided as a prepackaged unit sold separately from a prepackaged base unit or basic system.

Figure 4:
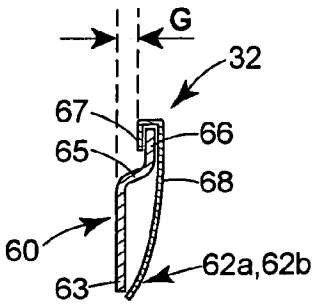
FIG. 4 shows a cross section of the top rail assembly taken along line IV-IV of the organizer system of FIG. 1.
Figure 2:
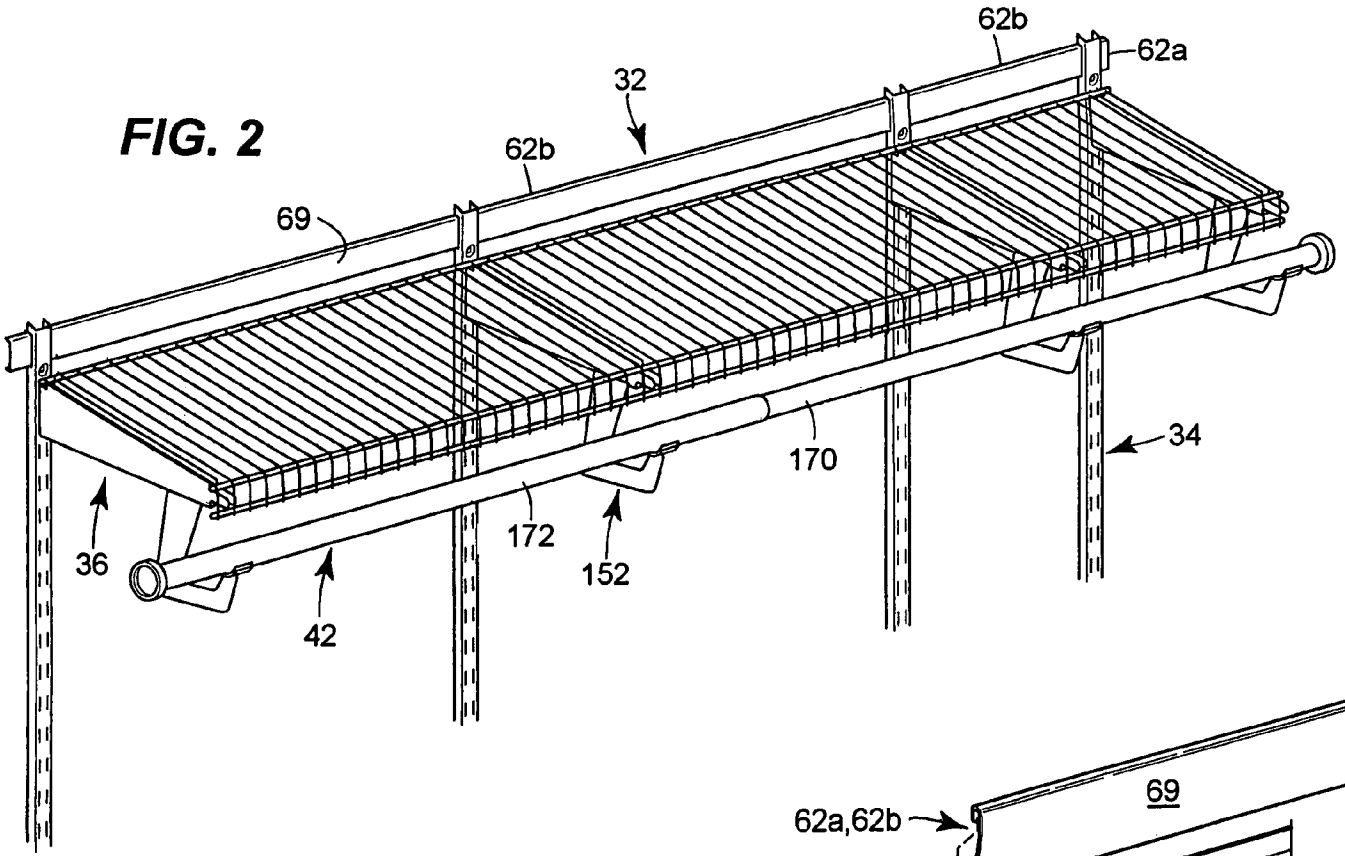
FIG. 2 shows an enlarged perspective view of an upper shelf portion of the organizer system shown in FIG. 1.
Figure 3:
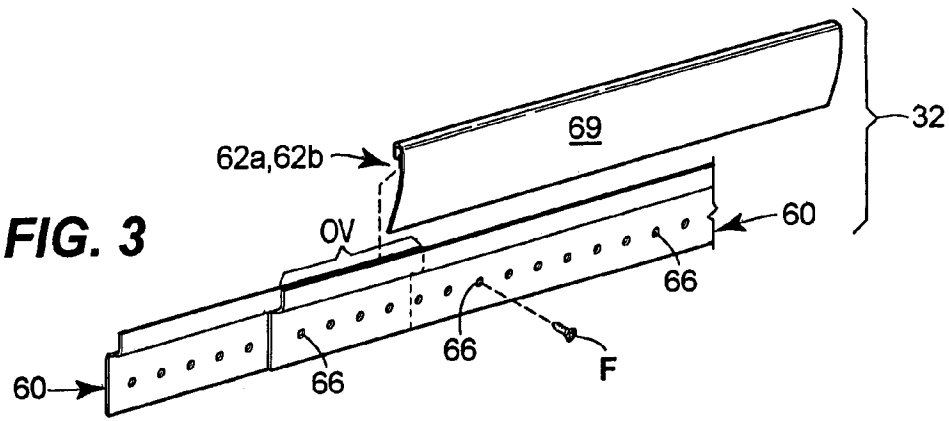
FIG. 3 shows a perspective and exploded view of a portion of the top rail assembly of the organizer system shown in FIG. 1.

As shown in FIGS. 2-4, the top rail assembly 32 is formed, in this example, having a plurality of substantially rigid support rail segments 60 constructed for mounting to a wall or other mounting surface. The top rail assembly 32 also includes, in this example, a plurality of decorative covers 62*a* and 62*b* that attach to the support rail segments 60. The covers 62*a* and 62*b* in this example are identical except in length or width. When referenced generally hereinafter, the covers will be identified as covers 62.

Aside from use as a decorative feature covering the support rail 60, the covers 62*a* and 62*b* also are used in the disclosed example as spacers for assisting a consumer in assembling and installing the system without the need for taking specific measurements. The covers come in at least two lengths including at least one initial cover 62*a* and plural intermediate covers 62*b*. The purpose and function of the different length initial and intermediate covers are discussed below in greater detail. Though the materials and construction of the support rail 60 and the covers 62*a* and 62*b* can vary, in one example, the support rail 60 is a metal structural component and the covers are plastic decorative components which can be easily cut using ordinary household scissors or the like.

As shown in FIGS. 3 and 4, each support rail segment 60 has a mounting section 63 that is generally planar and extends the length or, more appropriately, the width of the support rail and defines its bottom edge and part of the rail height. The rail segments 60 are adapted to mount to a mounting surface such as a wall to form part of the top rail assembly 32. The mounting section 63 of each segment 60 has a plurality of openings 64, which in this example are spaced 1 inch apart over the length or width of each rail segment. Fasteners of any type can be used to mount the rail segments to a mounting surface. The invention is not to be limited to any particular type of mounting used for the rail segments. However, to securely mount the entire system in one example, studs (not shown) can be located within a wall surface, fasteners F can be placed through appropriate ones of the openings 64 and driven through the wall into the studs. This procedure can be performed using multiple fasteners F to secure each rail segment 60 to a wall. Where appropriate, masonry fasteners can be used to secure the top rail assembly in place on a masonry wall.

Each rail segment 60 also has a step 65 and a support leg 66 extending upward from the step. In this example, the support leg 66 is generally parallel to the mounting section 63 but spaced in a different plane. When mounted to a surface, the support leg is spaced forward from the mounting surface creating a gap G. This gap G creates a space for the uprights 34 to be hooked onto and suspended from the support leg 66 in this example. Though not disclosed herein, other non-linear segmented configurations of the rail segments 60 can also be utilized.

As shown in FIG. 4, each cover 62 in this example has a downwardly extending mounting flange 67 that is spaced rearward from a body 68 of the cover and extends over its entire length or width. The flange 67 can be continuous or can be segmented into a number of discrete tabs if desired. The flange 67 is hooked over the mounting leg 66 of a rail segment 60 and received in the gap G when installed such that the covers also hang from the mounting leg 66 of the rail segments 60. The cover body 68 is sized in this example to cover the height of the exposed rail segments and fasteners. As shown in the example of FIG. 1, the cover body 68 can define a flat front facing surface 69. As shown in FIG. 4, the body can define a curved surface. As will be evident to those having ordinary skill in the art, the cover can be of virtually any configuration or construction and perform the aesthetic purpose of hiding the rail segments 60 and fasteners. Decorative features can also be added to the front facing surface to achieve virtually any desired appearance.

Figure 5:
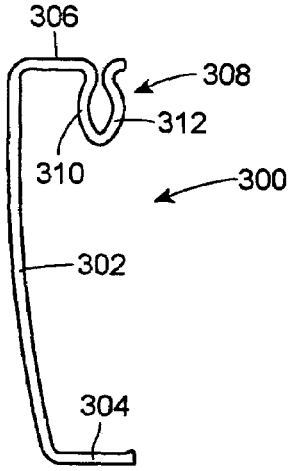
FIG. 5 shows an end view of an alternate example of a top rail cover for use with the top rail assembly of FIG. 4.

An alternate cover configuration is optionally shown in FIG. 5. In this example, the cover 300 has a cover body 302 that terminates at a lower end with a rearward extending flange 304. The flange 304 can aid in masking or hiding the top rail components. The cover 300 has a second flange 306 extending rearward from a top end of the body 302. A retaining lip 308 extends downward from the flange 306 spaced rearward from the body 302. The retaining lip 308 in this example has an arcuate shape that folds back onto itself to extend back upward. The lip 308 thus has two spaced apart, outwardly curved surfaces 310, 312. The spacing of the surfaces 310, 312 can be such that the surfaces are forced or compressed toward one another when the lip 308 is placed within the gap G between a mounting surface and a mounting leg 66 of a top rail segment 60. The outward bias of the compressed surfaces 310, 312 of the lip 308 can help to retain the cover 300 installed on the top rail assembly 32.

As shown in FIG. 3, the top rail 32 is width adjustable. Any two adjacent rail segments 60 can be placed in either end-to-end abutment or an overlapping relationship to a degree needed to attain a desired top rail width. FIG. 3 shows an overlap OV between two adjacent top rail segments 60. Depending upon the amount of overlap of the two segments, their combined length or width can be selected to achieve a width range from a minimum of the size of a single segment to a combined size of two abutted segments. Adding additional segments creates a wider top rail. Any top rail 32 width, from one segment width or longer, can be achieved as desired utilizing the top rails segments of the invention. In this example, the spacing of the openings 64 is one inch. Thus, the top rail width can be adjusted within one inch increments without the need of a drill by simply aligning openings 64 between overlapped segments 60.

Once the top rail segments are installed to a desired width, the uprights 34 and rail covers 62, 300 can be installed. As shown in FIG. 6A, the uprights 34, in one example, can be provided as a plurality of upright segments including upper segments 70, adapted for attaching to the top rail segments 60, and supplemental segments 72 adapted for connection to the upper segments 70 and to each other. Utilizing an upper segment 70 or a combination of one upper segment and one or more supplemental segments in series permits achieving a range of suitable upright lengths or heights for a given storage application.

Each upper segment 70 in one example is shorter in length than the supplemental segments 72. Each of the supplemental segments 72 is of the same length. However, different length variations can be utilized such as providing all segments of the same length, upper segment being longer than the supplemental segments, or a variety of different length segments.

As illustrated in FIG. 6A, each of the upright segments 70 and 72, in this example, is a U-shaped channel with two side surfaces 74 and a forward facing or front surface 76. Pairs of laterally spaced apart apertures 78 are provided in the front surface and oriented in a longitudinal direction and spaced apart over the length of the segments. The front surface 76 of each segment also includes a pair fastener openings 79, one each spaced from an end of the segment in this example. The segments can be secured to or at least retained in position against a mounting surface utilizing fasteners F received through these openings 79. The upper segments may only have a single opening 79 near a lower end 80, or may have an opening 79 at each end, as in another example described below.

In this example, each of the shorter upper segments 70 includes a cut out section 82 in the free edge 81 of each of the opposed the side surfaces 74 adjacent a top end 84 of the segments. The cut outs 82 mirror one another and each has an upward portion with a downwardly extending tab 86 defining an upward extending notch 88. The opposed tabs 86 hook over the support leg 66 of a rail segment 60. The leg 66 rests within the opposed notches 88 to suspend the upright segment from the top rail 32. The remaining portion of the cut outs 82 can be configured to follow the contour of the top rail segments 60, as in the example described below, or can simply be sized to provide clearance for the top rail configuration therein, as in this example. The notches 88 can be sized to create a slight friction fit, if desired, between the upright segment 70 and the rail segment 60 when assembled.

Figure 6B:
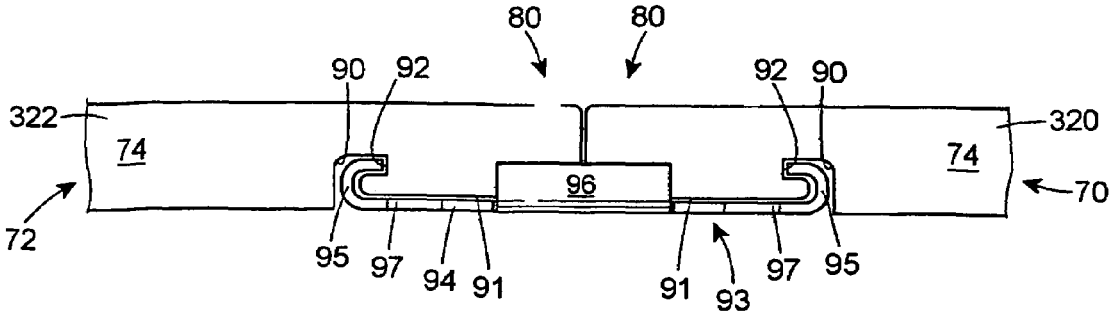
FIG. 6B shows a side view of a joint between the two adjacent vertical uprights of FIG. 6A and after assembly.
Figure 6A:
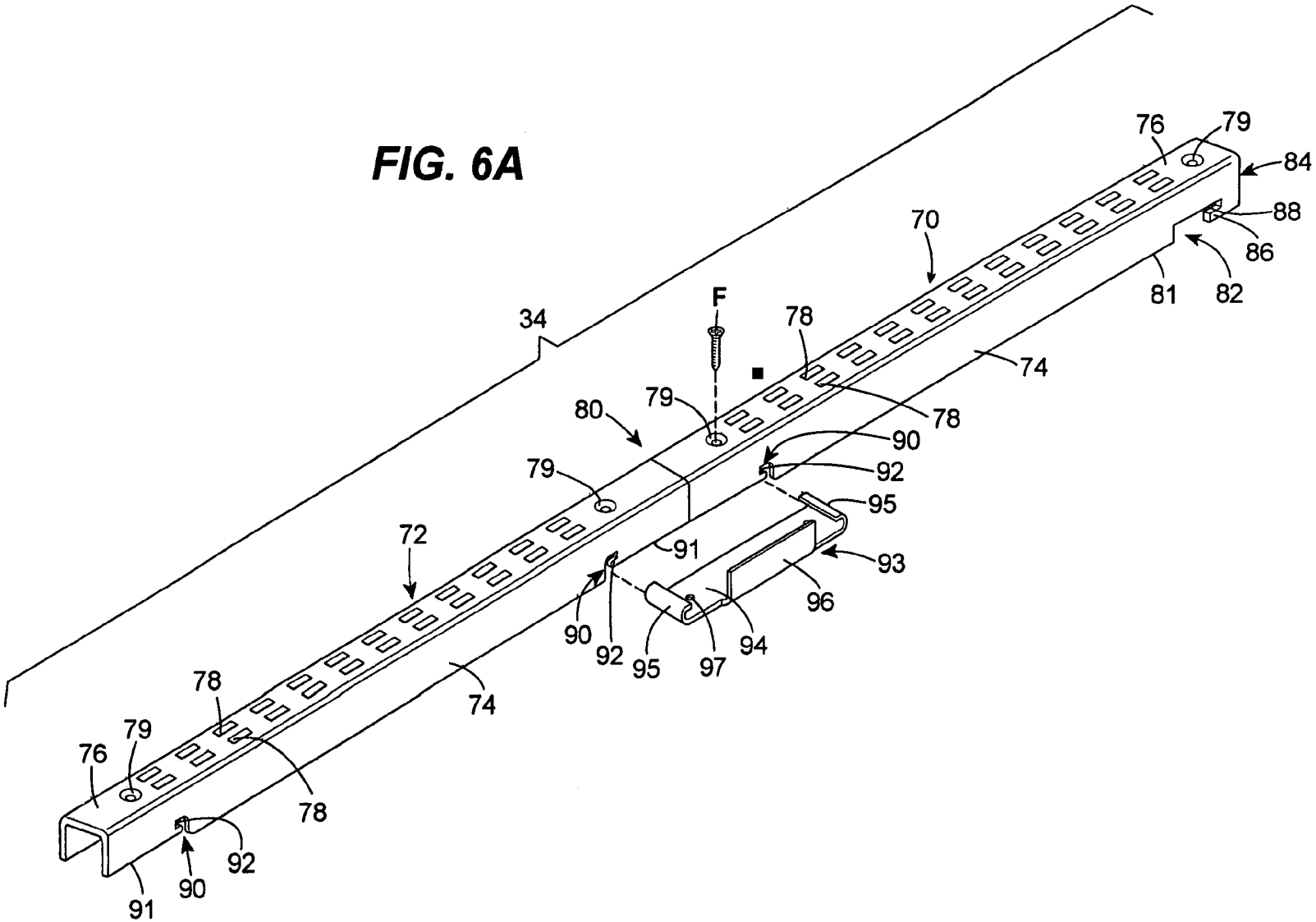
FIG. 6A shows a perspective and partially exploded view of one example of an upright assembly of the organizer system as shown in FIG. 1.

As shown in FIGS. 6A and 6B, the lower end 80 of the upper segments and each end of the supplemental segments 72 also include similar but smaller cut outs 90 in the free edge of the side surfaces 74. Each of these cut outs 90 is an L-shaped or J-shaped opening also defining a notch 92 that extends in a direction toward its respective segment end. As shown, when two segments are abutted together, whether it be two segments 72 or one segment 72 with the bottom end of a segment 70, the notches 92 extend toward one another.

Clips 93, as shown in FIGS. 6A and 6B, are disclosed herein for securing two adjacent and end-to-end abutting upright segments together. Each clip 93 has an elongate body 94, a pair of identically curved L-shaped or J-shaped hooks 95, one at each end of the body, and a bearing plate 96. The bearing plate 96 extends from one edge of the clip body 94, is oriented perpendicular thereto, and extends between and in the direction of the hooks 95. Each hook 95 has a width and is shaped to be received in the opposed notches 92 of one of the abutting segments. When fully installed, the bearing plate 96 will bear against a portion of the side surface 74 of each segment. The clip 93 will loosely hold the two segments in end-to-end engagement, one hanging from the other, until fasteners F are used to secure the segments to the mounting surface. Free edges of the side surfaces 74 at the ends of the abutting segments define recessed portions 91. The recessed portions are recessed into the edge of the side surfaces toward the front surface of the respective segment. As shown in FIG. 6B, the clip 93 will rest flush with the remaining portions of the free edges of the segments when installed. Holes 97 in the clips 93 are positioned to align with the corresponding openings 79 in each abutting segment to facilitate installation and to hold the clip 93 in place when installed.

Figure 7:
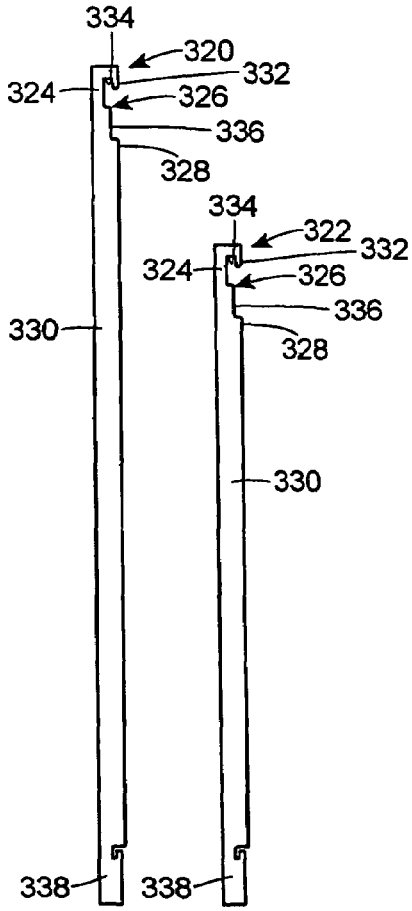
FIG. 7 shows a side view of two alternative upright segments for use with the organizer system as shown in FIG. 1.

FIG. 7 shows another example of an upright segment arrangement. In this example, the organizer system can be provided with a plurality of upright segments, each configured to either hang from the top rail assembly 32 or to couple with another one of the segments. Thus, the uprights are provided having one or more first upright segments 320 of a first height and one or more second upright segments 322 of a second height that is shorter than the first height in this example. Other than height, the segments 320 and 322 in this example are identical.

Each segment 320, 322 has a first end 324 configured to connect to the top rail assembly 32. The first end 324 includes a cut out section 326 in the free edge 328 of each of the opposed the side surfaces 330 adjacent the first end. The cut outs 326 again mirror one another and each has an upward portion with a downwardly extending tab 332 defining an upward extending notch 334. The opposed tabs 332 hook over the support leg 66 of a rail segment 60. The leg 66 rests within the opposed notches 334 to suspend the upright segment from the top rail 32. The remaining portion of the cut outs 326 in this example include a stepped surface 336 configured to follow the contour of the top rail segments 60. The notches 334 again can be sized to create a slight friction fit, if desired, between the upright segment 70 and the rail segment 60 when assembled.

A second end 338 of the segments 320, 322 is essentially identical to the previously described segments 70, 72 and are configured to couple to one another via use of the clip 93. Thus, the second ends 338 include the smaller cut outs 90 in the free edge of the side surfaces 330. Each of these cut outs 90 is again an L-shaped or J-shaped opening also defining a notch 92 that extends in a direction toward its respective segment end. As shown, when two segments 320, 322 are abutted together, the notches 92 extend toward one another and the clip 93 can be installed.

Thus, in this example, an organizer unit can be provided with a plurality of the first segments 320 and a plurality of the second segments 322. Various height uprights can be achieved by either using only the first segments 320, only the second segments 322, interconnecting a first segment with a second segment, interconnecting two first segments, or interconnecting two second segments to form an upright.

Figure 8:
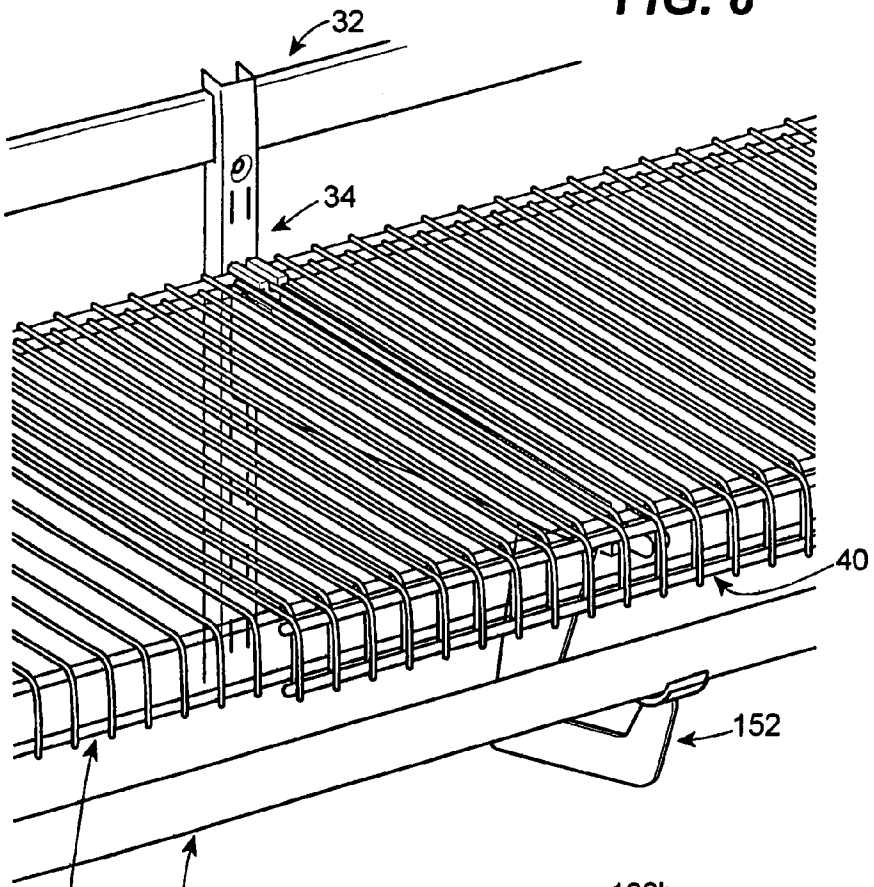
FIG. 8 shows an enlarged top perspective view of a shelf portion and shelf mounting arrangement of the organizer system shown in FIG. 1.
Figure 9:
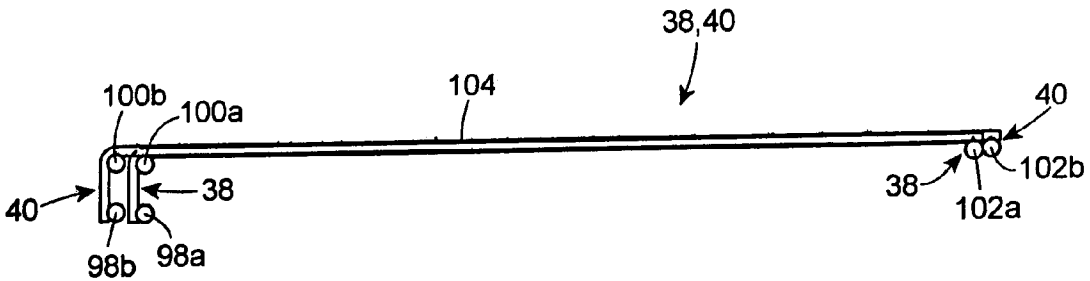
FIG. 9 shows an end view of the overlapped shelves as shown in FIG. 8.

As shown in FIGS. 8 and 9, the shelves 38 and 40 are essentially identical in construction, except that they are slightly different in relative size. Each of the shelves 38 and 40 has a side-to-side length or width and a shelf depth from forward to rear end. Each shelf 38 and 40 in the disclosed example has a pair of elongate front wires 98*a*, 100*a* and 98*b*, 100*b*, respectively, that are the forward end wires. The wires 98*a*, 98*b* are referred to generally as wires 98 and the wires 100*a* and 100*b* are referred to generally as wires 100 herein when not referring to a specific shelf. The wires 98 and 100 are spaced vertically apart and parallel to one another and extend the length or width of the respective shelf. The spacing of these two wires 98 and 100 define a shelf height. In the disclosed example, each shelf 38 and 40 also includes an elongate single wire 102*a* or 102*b*, respectively, that is the rear end wire. Each rear end wire 102 also extends along the shelf width, is generally parallel to the respective wires 98 and 100, and defines a rear end of the shelf. The gap between the upper most wire 100 of the front wires and the rear wire 102 defines the depth of the respective shelf 38 or 40. The length or width of the wires 98, 100, and 102 generally define a length or width of the corresponding shelf 38 or 40.

Each shelf 38 and 40 also has a plurality of closely spaced apart transverse wires 104*a* and 104*b*, respectively, positioned in this example generally perpendicular or normal to the respective elongate wires 98, 100, and 102. These wires 104 are at one end attached to the rear wire 102, such as by welding, and extend forwardly from the rear wire. The wires 104 in this example are then bent at a forward end over the upper most front wire 100. A down turned portion of the wires 104 extend downward toward and connect to the lower front wire 98. The forward or down turned end of the wires 104 are attached to each of the wires 98 and 100, also such as by welding. The wires 104 are described herein as being transverse to the longitudinal direction and are therefore identified as the transverse wires, though they extend front to back relative to the shelf orientation. These transverse wires 104 define a support surface 108 on which items can be stored on the shelves 38 and 40.

As shown in FIG. 9, the smaller shelves 38 are sized to fit and nest within the larger shelves 40. Thus, portions of two end-to-end adjacent shelves 38 and 40 can overlap with one another. The transverse wires 104*a* and 104*b* of the overlapped portions of the shelves 38 and 40 will sit side by side, i.e., lie in the same plane, with one another. The rear wires 102*a* and 102*b* of the overlapped portions of the shelves are positioned horizontally adjacent one another with the rear end wire 102*a* of the smaller shelf 38 positioned interior to the rear wire 100*b* of the larger shelf 40. Similarly, the upper front wire 98*a* of the shelf 40 is positioned in the same plane but outward of the upper front wire 98*b* of the shelf 38, and the lower front wire 100*a* of the shelf 40 is positioned in the same plane but outward of the lower front wire 100*b* of the shelf 40, as shown in FIG. 9.

Using the shelves as disclosed herein, a shelf can be constructed having virtually any width by overlapping alternating shelves 38 and 40, from a minimum of one single shelf width to any longer width as desired. For each shelf 38 and 40, the bent portions of the wires 104 depend downward and, together with the wires 98 and 100, provide structural rigidity to the shelf. Further, when overlapped, the transverse wires 104*a* and 104*b* lie in the same plane to form a support surface 108 that is essentially of one plane. The shelf 40 has a larger depth between its rear wire 102*a* and its front wire 100*a* than the shelf 38 has between its rear and front wires 102*b* and 100*b*. Thus, the larger shelf 40 can overlap with and nest over the smaller shelf 38 to any degree desired.

In the disclosed example, the transverse wires 104*a* and 104*b* of the two shelves 38 and 40 have the same spacing. Thus, when overlapped, the transverse wires 104*a* and 104*b* alternate between one another in the overlapped region of the two shelves. The spacing of the transverse wires 104*a* can be different from that of the wires 104*b*, although the spacing should be such that the shelves can be permitted to overlap with one another.

Figure 10:
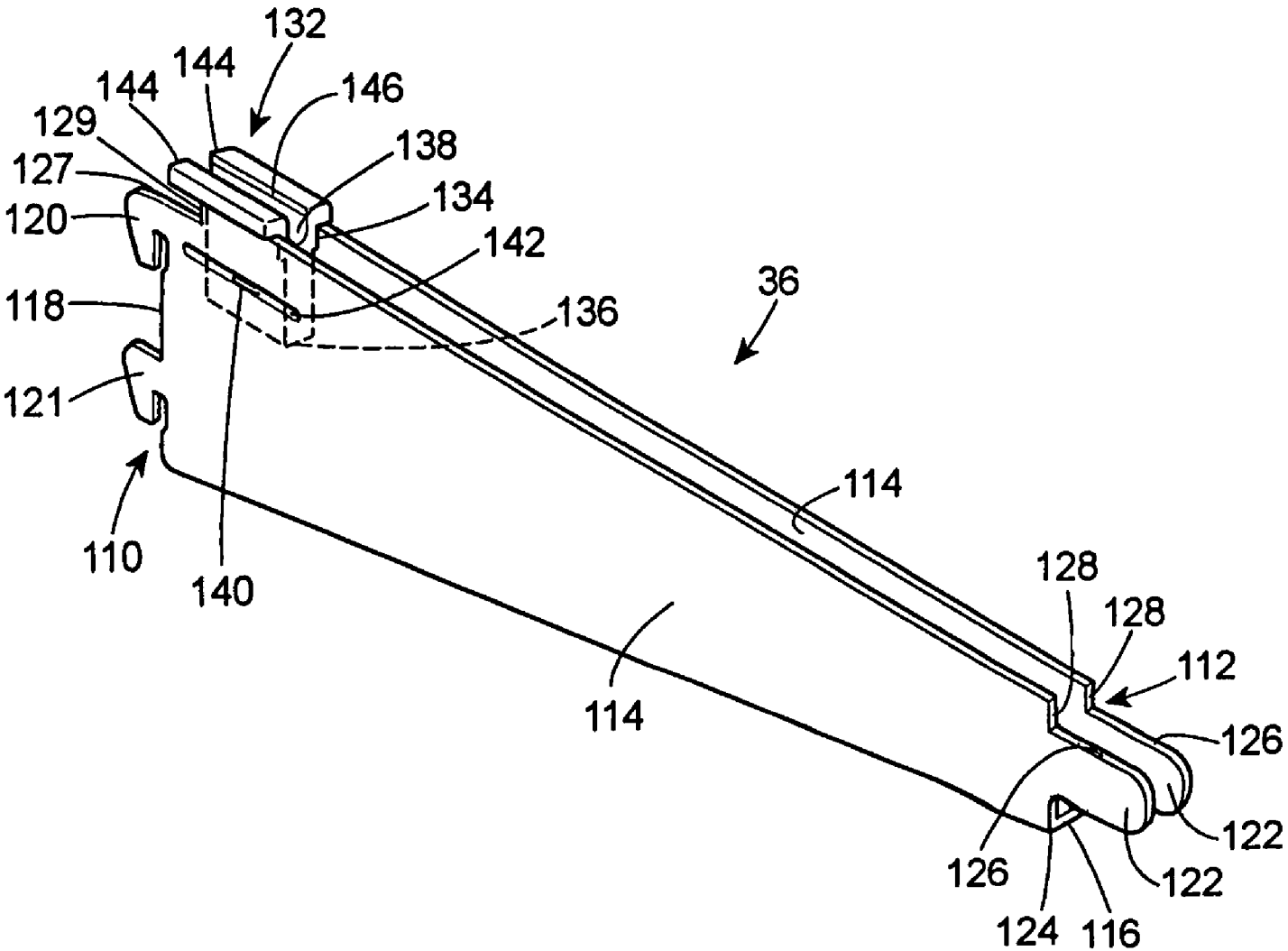
FIG. 10 shows a perspective view of one example of a shelf mounting bracket of the organizer system shown in FIG. 1.

FIG. 10 illustrates one example of the shelf mounting brackets 36. Each bracket 36 has a generally triangular configuration in side profile with a rear end 110 and a forward end 112. The rear end 110 is taller than the forward end 112 to form a buttress-like shelf supporting structure. As shown in FIG. 10, the bracket 36 in the disclosed example has a generally tall and thin U-shaped configuration with an open top and a closed bottom. A pair of spaced apart sides 114 of the bracket 36 is connected along an integral bottom surface 116. Each side 114 has a back edge 118 defining part of the rear end 110. A pair of vertically spaced apart and downwardly extending L-shaped hooks extend from each back edge 118. Thus, as can be gleaned from FIG. 10, each bracket 36 in this example includes a pair of laterally spaced upper hooks 120 and a pair of laterally spaced lower hooks 121 at the rear end 110 of the bracket. The placement of the hooks corresponds in lateral spacing and in vertical spacing to the positioning of the apertures 78 in the vertical uprights 34.

Also as can be seen in FIG. 10, each bracket 36 in the disclosed example includes a pair of forwardly extending fingers 122, one each extending from a forward edge 124 of a respective side 114 of the bracket. Top surfaces of the fingers 122 define front shelf supports 126 for the shelves. Rear shelf supports 127 are defined on a top edge of the upper hooks 120 and lie generally in the same plane as the front shelf supports 126. Each of the shelf supports 126, 127 lies at a level below an upper edge of the bracket side walls 114. The upper part of the forward edges 124 form vertical or inclined stops 128 arranged to transition between each of the front shelf supports 126 of the fingers 122 and the respective upper edges of the side walls 114. Similarly, an upper part of the back edges 118 form vertical or inclined stops 129 arranged to transition between each of the rear shelf supports 127 and the upper edges of the side walls 114.

The distance between the front stops 128 and rear stops 129 in this example is sufficient to support the front and rear wires 100*a* and 102*a* of the smaller shelf 38 on the shelf supports 126 and 127, respectively, and closely borne against the stops. This will assist in preventing the smaller shelf 38 or two overlapped shelves 38, 40 from sliding forwardly or rearwardly on the brackets. The size or depth of the shelf supports 126, 127 in this example is sufficient to support two overlapped shelves 38, 40 on the supports. The depth of the shelf supports 126, 127 is also sufficient to support the front wire 100*b* of only a larger shelf 40 with the rear wire 102*b* borne against the rear stop 129. This will prevent the shelf 40 from-1falling off the front fingers 122 when only the larger shelf is supported by the brackets 36.

As will be evident to those having ordinary skill in the art, the material for forming the brackets 36 can vary and yet fall within the spirit and scope of the invention. In one example, the brackets 36 are formed from flat metal sheets, stamped to include optional structural ribs, ridges, or depressions (not shown) in the sides 114, and then bent to form the bottom 116 and the spaced apart sides 114. The brackets can then be suitably plated, painted, or otherwise coated as desired to achieve a particular surface finish and aesthetic appearance. Alternatively, the brackets can be constructed as a solid piece, as a bent metal welded structure, as a plastic molded structure, or other suitably sturdy structure.

Also as shown in FIG. 10, one example of a locking clip 132 is installed in each bracket 36 between the side walls 114 near the rear end 110 adjacent the rear shelf supports 127. Each locking clip 132 generally has a clip body in U-shaped configuration with a pair of upstanding sidewalls 134, a bottom wall 136, and a wire receiving, open ended channel 138 defined between the sidewalls. In this example, each sidewall 134 also has a laterally outward projecting elongate rib 140. Each bracket side 114 has a corresponding elongate slot 142 that is greater in length than each of the ribs 140. The clip is inserted through the open top between the sidewalls 114 in the bracket 36 with the open top of the channel 138 facing upward. Each rib 140 is received in a corresponding one of the slots 142. Because the ribs are shorter in length than the slots, the clip can slide back and forth relative to the bracket.

Each clip 132 also has a pair of rearward extending projections 144, one from each sidewall 134. When installed, the projections 144 face toward the rear end 110 of the bracket 36. The clip 132 can slide to a forward, unlocked position depicted in FIG. 11B with the projections providing vertical clearance to the rear shelf supports 127. The clip 132 can also slide to a rearward, locked position depicted in FIG. 11A with the projections covering but spaced upward from the rear shelf supports 127 to lock a shelf in place on the bracket 36. Each clip can further have a pair of optional detent ridges 146 that extend inwardly toward one another into the channel, one each from each sidewall 134 at the channel opening. The detent ridges 146 can be sized to require a shelf wire 104 to snap into the channel 138 to assist in retaining the shelf on the bracket 36.

Figure 12A:
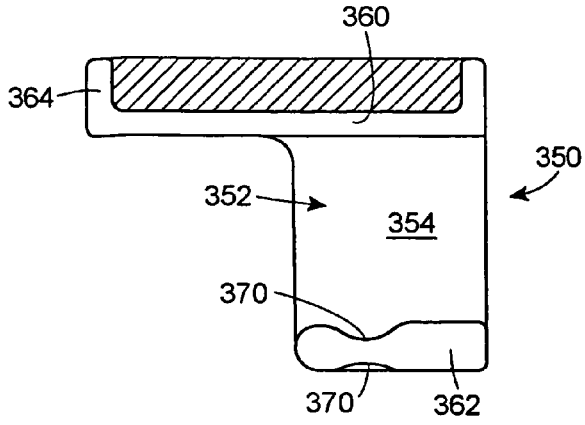
FIGS. 12A and 12B show a side view and a front view, respectively, of an alternative example of a locking clip for the shelf mounting brackets of the organizer system.
Figure 12B:
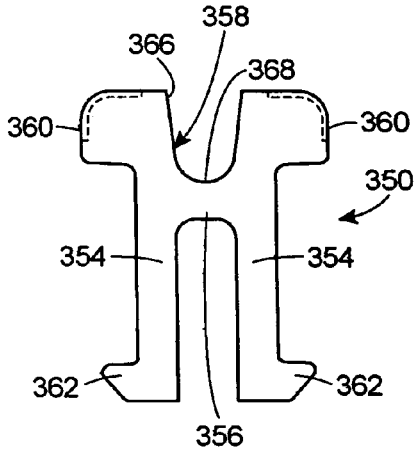

FIGS. 12A and 12B illustrate another example of a locking clip 350 that is similar to the clip 132 but with a variety of different features. The clip 350 has a U-shaped clip body 352 also with a pair of upstanding sidewalls 354, a bottom wall 356, and a wire receiving, open ended channel 358 defined between the sidewalls. In this example, each sidewall 354 also has a laterally outward extending top flange 360 and an outward projecting elongate bottom rib 362. The flanges and ribs 360, 362 extend the length of the body 352. The top flanges 360 ride along the upper edges of the bracket side walls and the bottom ribs 362 replace the ribs 140 in the previous clip example. Each clip 350 also has a pair of rearward extending projections 364, one from each sidewall 354, similar to the projections 144 of the previously described clip 132.

The channel of the clip 350 in this example is wider at its open top 366 than at its closed bottom 368, thus permitting a shelf wire 104 to easily drop into the channel. The ribs 362 of this clip example have a generally constant thickness in a vertical direction as shown in FIG. 12A, except for a pair of vertically opposed dimples 370. The dimples 370 are provided to cooperate with bumps in the slots of the bracket to assist in holding the clip 350 in the locked position as described below.

Figure 13A:
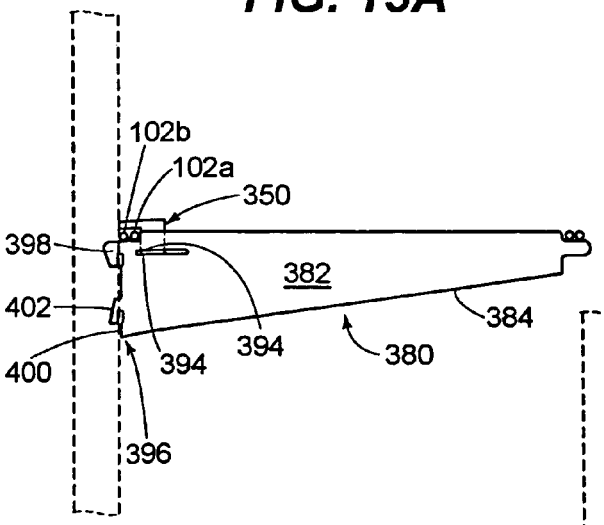
FIGS. 13A and 13B show a side view of an alternative example of a shelf mounting bracket installed in an organizer system and showing the locking clip in the locked and unlocked positions, respectively.
Figure 13B:
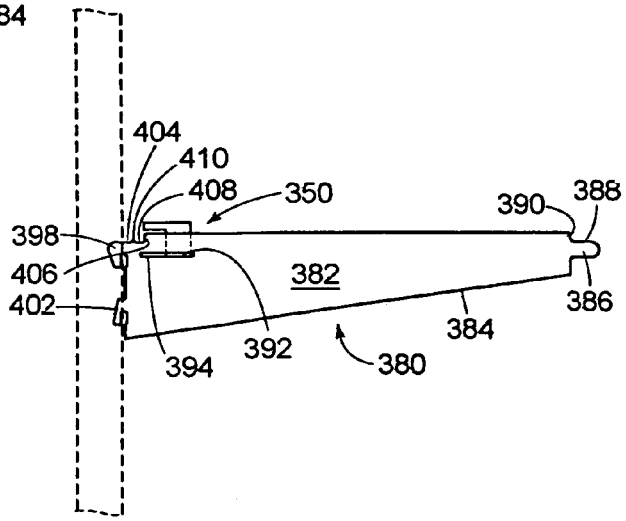

FIGS. 13A and 13B show an alternative example of a mounting bracket 380 with the alternate clip 350 installed therein and shown in both the locked and the unlocked positions. The bracket 380 in this example is similar to the previously described bracket 36, but has a number of differences. The bracket 380 has a U-shaped body with side walls 382, a closed bottom wall 384, and an open top. The front end of the bracket 380 has a pair of forwardly extending fingers 386 that create front shelf supports 388 thereon. A front stop 390 is also provided similar to the front stop 128 of the bracket 36. These portions of the bracket 380 are essentially the same as the bracket 36.

The bracket 380 also has a clip slot 392 in each side wall 382. Each slot has a pair of opposed bumps 394, which engage in the dimples 370 of the clip 350 to hold the clip in the locked position as shown in FIG. 13A. The slots 392 again are long enough to permit the clip 350 to slide between the locked position and the unlocked position shown in FIG. 13B.

A rear end 396 of the bracket 380 includes a pair of laterally spaced apart upper hooks 398 extending rearward from back edges 400 of the side walls 382. Instead of lower hooks as in the previous example, the bracket 380 has a pair of laterally spaced apart lower tabs 402 extending rearward from the back edges 400 of the side walls 382. The tabs 402 are positioned beneath and spaced from the upper hooks 398. The tabs and hooks are again positioned to be received in selected ones of the apertures in the uprights. The hooks 398 hold the bracket 380 in place and the tabs 402 keep the bracket from moving laterally or twisting.

The bracket 380 also has rear shelf supports 404 formed on the upper edge of the upper hooks 398. A rear stop 406 is provided and is again similar to the rear stop 129 of the bracket 36. In this example, the rear shelf supports 404 have a notched region 408 adjacent the rear stop 406 in which a rear shelf wire 102 can rest when installed. An upward extending nub 410 separates the notched region from the rest of the shelf support 404. When only a large shelf 40 is supported on the shelf support 404, the notched region 408 or the nub will assist in keeping the shelf from moving by retaining the rear wire 102*b* either behind the nub 410 or in the notched region 408. When only a smaller shelf 38 is supported on the shelf support 404, the rear wire 102*a* will rest within the notched region 408 firmly hold the shelf in position.

As shown in FIG. 13B, when the locking clip 350 is in the unlocked position, the projections 364 provide vertical clearance to the rear shelf supports 404. When in the locked position of FIG. 13A, the projections 364 extend over the rear shelf supports 404, but do not extend into apertures 78 of the upright 34, as the projections 144 did in the prior example. Instead, the ends of the projections 364 merely abut the front surface of the upright 34. The rib dimples 370 and slot bumps 394 assist to hold the locking clip 350 in the locked position. The abutment of the projections against the upright 34, along with the positive positioning in the locked position, inhibits upward rotation of the mounting bracket 380 when installed. This resists unwanted removal or dislodgement of the bracket from the upright 34. Thus, the locking clips 350 also assist in securing the mounting brackets in place once installed.

The previously described examples of the components form the basic overall organizer system 30. In one example, to assemble a bare bones organizer system in accordance with the teachings of the present invention, one would require at least two upper upright segments 70, at least one top rail segment 60, at least two shelf mounting brackets 36, and at least one shelf 38 or 40. In other examples, the upright segments 320, 322 could be used in a similar fashion, though not set out in detail here. Further, the mounting brackets 380 could alternatively be utilized in a similar fashion, though also not set out in detail here.

The single top rail segment 60 can be mounted horizontally level to a mounting surface. The segment 60 can be secured by conventional fasteners through the openings 64 to that surface, and particularly, to studs or other stable portions of the surface. The two upper segments 70 can then be suspended from the top rail by hooking the tabs 86 of the cutouts 82 over the rail support leg 63 and suspended therefrom. If desired, one or more fasteners can be utilized through the available fasteners openings 79 in the uprights 70 to further secure the uprights to the mounting surface in a vertical orientation.

The upper and lower hooks 120 and 121 of a bracket 36 can be placed in selected apertures 78 in the upright segments 70. First, a bracket 36 is held horizontally and moved toward an upright segment 70. Once the L-shaped hooks 120 and 121 are passed into and through the selected apertures 78, the mounting bracket 36 can be dropped or pushed downward into position such that the hooks 120 and 121, and corresponding notches formed thereby, interlock with the material of the upright 70 beneath the selected apertures. The second bracket 36 can be similarly mounted to the second short segment 70 at the same elevation. With the clips 132 in the unlocked position of FIG. 11B, a shelf is then positioned over the mounting brackets. One of the transverse wires 104 of the shelf is aligned between each pair of fingers 122 of each bracket 36. The rear wire 102 of the shelf will rest on the rear shelf supports 127 and the front wire 100 will rest on the front shelf supports 126.

Figure 11B:
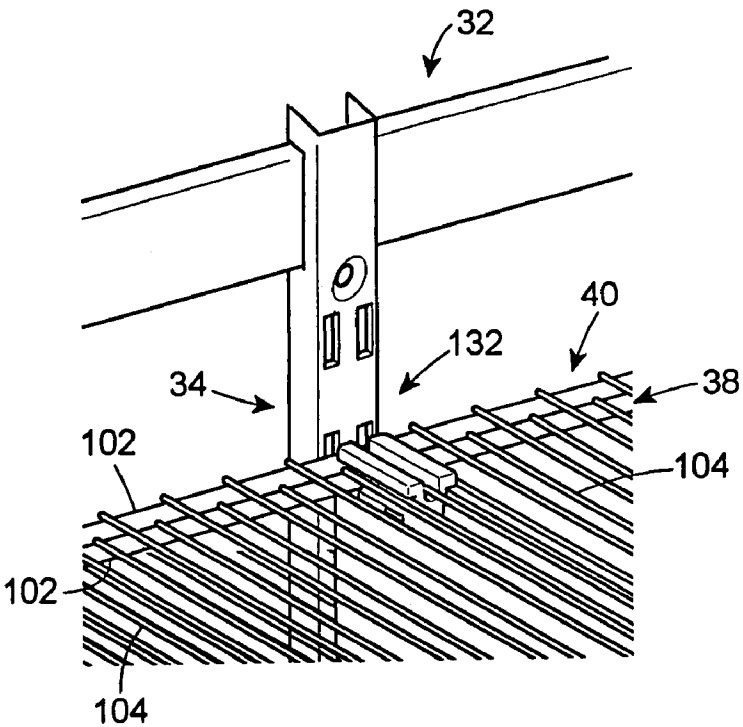
FIGS. 11A and 11B show an enlarged view of a portion of a shelf mounting bracket and installed shelf of the organizer system shown in FIG. 8 with the clip in a locked position and in an unlocked position, respectively.
Figure 11A:
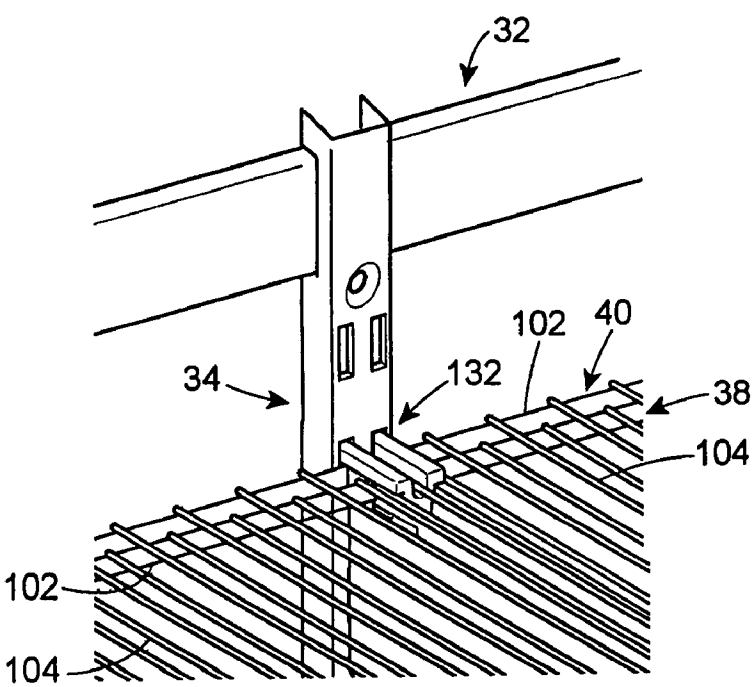

As shown in FIGS. 11A and 11B, the same aligned transverse shelf wires 104 will also align with and be received in the respective channels 138 of the clips 132 near the rear wire 102. The wire 104 in this example is snapped through the detent ridges 146 and into the channel 138. This would not be necessary for the clips 350. Once the shelf 38 or 40 is dropped into position, the bracket clip 132 can then be slid rearward to the locked position of FIG. 11A. When locked, the projections 144 pass into adjacent ones of the adjacent apertures 78 in the respective upright 70 in this example. The channel 138 depth and projection 144 length are such that, when the wire 104 is fully seated, the projections will overlie the wire 102 when locked. The projections 144 and the slots 142 in the brackets 36 are of such a length that the projections will overlie the single rear wire 102. The clip 132 and the stops 128, 129 at least loosely secure the shelf in place. The shelf can thus not be easily lifted or shifted from this installed position.

In another example, to assemble a larger scale organizer system, two or more of the top rail segments 60 can be assembled used to construct the top rail 32. The plural segments 60 can either be end-to-end abutted or overlapped to a degree needed to achieve a desired width for the completed top rail assembly 32. As shown in FIG. 3, a string or series of top rail segments 60 can be extended across an entire width of a storage space, or only a fraction of the space, as desired. One end of a first segment 60 can be horizontally oriented and abutted, if desired, against a wall adjacent the mounting surface. Additional segments 60 can then be horizontally abutted or overlapped with previously installed segments to achieve the desired width. The top rail segments 60 can then be secured utilizing conventional fasteners through the openings 64.

In this larger scale example, the covers 62*a* and 62*b* or 300 can be utilized. In one example, a first one of the covers 62*a* (i.e., the short cover) can be hooked onto, as described above, the first installed top rail segment 60 abutting the adjacent wall of the storage space. In one example, this cover 62*a* is about six (6) inches in length, or some predetermined length to provide a minimum spacing for a first one of the uprights relative to the adjacent wall. A first one of the upper uprights 34, whether it be a segment 70, 320, or 322, can then be installed over the top rail 32 abutting the distal or exposed end of the short cover 62*a*. Thus, the first upright segment is positioned about 6 inches from the adjacent wall.

To achieve ideal spacing of the remaining uprights 34 in this example, the longer covers 62*b* can also be provided in specific lengths and utilized as spacers. In one example, each of the covers 62*b* can be about twenty-three (23) inches long to provide 24 inch spacing (including the width of adjacent one inch wide uprights 34) between uprights. Thus, the sequence for installing a larger scale organizer is to mount the top rail 32, attach the short cover 62*a*, attach one of the upper uprights 34, and then in sequence attach a longer cover 62*b*, another upright, another cover, repeating the sequence as needed for a given storage space. Once all the desired uprights 34 are hung, they can be secured with fasteners as needed through the openings 79.

The covers, shelves, and rails can be sized to require any desired standard spacing, and are not limited to any particular dimensions. The two-foot spacing described herein is simply for illustration purposes. For example, the covers can be provided in 36 inch or 48 inch lengths to achieve a different predetermined spacing between uprights. The shelves can thus be provided in corresponding sizes to fit the predetermined spacing for a given organizer system. Thus, shelves can be provided in 24, 26, or 48 inch lengths, for example. The invention is not intended to be limited to any particular size of shelf or cover.

Further, as will be evident to those having ordinary skill in the art, not all storage spaces will permit the same spacing (such as 24 inches used in this example) between every adjacent upright 34. The disclosed invention is highly adjustable and versatile to accommodate this problem without requiring cutting of shelves, rail segments, uprights, or any other part. Where a smaller spacing is required between any two uprights, as depicted in the right hand side of FIG. 1, the overlapping capability of the shelves 38 and 40 and the rail segments 60, each described earlier, permits adjusting the components to fit virtually any size storage space as long as it is wider than a minimum of one shelf width.

To further install the larger scale organizer system 30, additional supplemental upright segments 72 or segments 320, 322 can then be installed, as described above, hanging from any one or more of the previously mounted upright segments 70, 320, 322 in order to provide a desired length for the vertical uprights 34. Each upright 34 need not be the same length, depending upon the needs of a particular customized storage space. One or more of the interior or outer most uprights 34 can be shorter or taller in height to accommodate different storage space configurations as well as different configurations for the organizer unit.

A plurality of shelf mounting brackets 36 or 380 can then be attached where desired to the installed uprights 34. Shelves 38 and 40 can then be installed on the mounting brackets as described above to complete the basic component installation. Where needed, a shelf 38 can be overlapped to any degree necessary by a shelf 40 to adjust shelf width or length to fit a given space. Again, the construction of the shelves 38 and 40 permits any shelf width from a minimum width equal to a width of a single shelf 38 or 40 to any desired maximum width. This is particularly useful where the maximum standard spacing of a given system, such as 24, 36, or 48 inches between uprights can not be achieved in a given storage space. One or more of the uprights 34 may need to be installed closer to its adjacent upright, such as shown in FIG. 1, right hand side. A consumer need not cut any component of the system, other than a cover 62*b* to fit a smaller upright spacing. The clips 132 or 350 can accommodate covering the wires 102*a*, 102*b* of overlapped shelves when in the locked position, as is shown in FIG. 13A.

The consumer also need not secure any other component, other than the top rail to a substantial support surface. Once the top rail is secured in place properly, the uprights simply hang from the rail at any desired lateral position. The consumer can use fasteners to hold the uprights in place, but need not attach such screws to studs or other foundation elements because the top rail provides the vertical load bearing support.

The uprights 34 are also easily adjusted in height. The configuration of the clips 93 and the segment ends permits a segment to be added onto a previously installed segment simply by slipping a clip 93 in place behind the existing upright with the hooks in the corresponding notches. The added segment can then be slipped into place and hung from the other end of the clip 93. Screws can be used to secure the clip in place and to secure the segments to the surface. However, these screws do not provide the load bearing function for the uprights. Instead, the clip 93 does the load bearing for the extended upright. Thus, the added-on segments also need not be secured to a foundation element, such as a stud, of the wall surface.

The disclosed organizer system 30 can be marketed and offered for sale in various unique package combinations, or as an entire deluxe system. In one example, either one or a range of base pre-packaged organizer systems can be offered that includes a minimal number of basic components to install one or more shelves 38 and/or 40 in a storage space. Additional pre-packaged upgrade kits and/or accessory kits can also be offered separately to the consumer. The consumer need only pick one of the base kits or packages to suit their needs and select one or more of the upgrade or accessory kits to create a fully personalized storage unit.

In one example, two different pre-packaged base kits can be offered. One of the kits can be a three to six foot kit that includes a plurality of the longer upright segments 320 and shorter upright segments 322, a plurality of the shelf mounting brackets 380 and clips 350, a plurality of the connector clips 93, and at least one three foot shelf 38 and at least one three foot shelf 40.

This base kit can be installed to accommodate any storage space having a three foot minimum width to a maximum six foot width. A second pre-packaged base kit could be offered including essentially the same components, but with one four foot shelf 38 and one four foot shelf 40. This second kit would be suitable for storage spaces between widths of four feet and eight feet. These kits can also be offered with three or four foot covers, respectively, to simplify the installation of the selected unit. Upgrade kits can then be offered to the consumer to amplify and/or personalize their unit. An upright kit including additional segments 320 and 322 and clips 93 can be offered separately. A shelf kit including a plurality of additional shelves 38 and 40 of appropriate length can also be offered separately. A bracket kit including additional shelf mounting brackets 380 with clips 350 can be offered as a separate upgrade kit or as a combined kit with additional shelves. A deluxe upgrade kit can be offered that includes a plurality of the upright segments, clips 93, brackets, and shelves. Other variations are certainly possible. The disclosed prepackaged kits are only described herein as examples of such options.

Accessory kits can also be offered to the consumer for further enhancing and personalizing their storage organizer unit. These accessory kits can also be offered as prepackaged kits that include the necessary mounting hardware and the particular storage accessory. Examples of such accessories and kits are provided below. The disclosed examples are also not intended to limit in any way the potential accessories that may be made available for the organizer system 30 disclosed herein.

Figure 14:
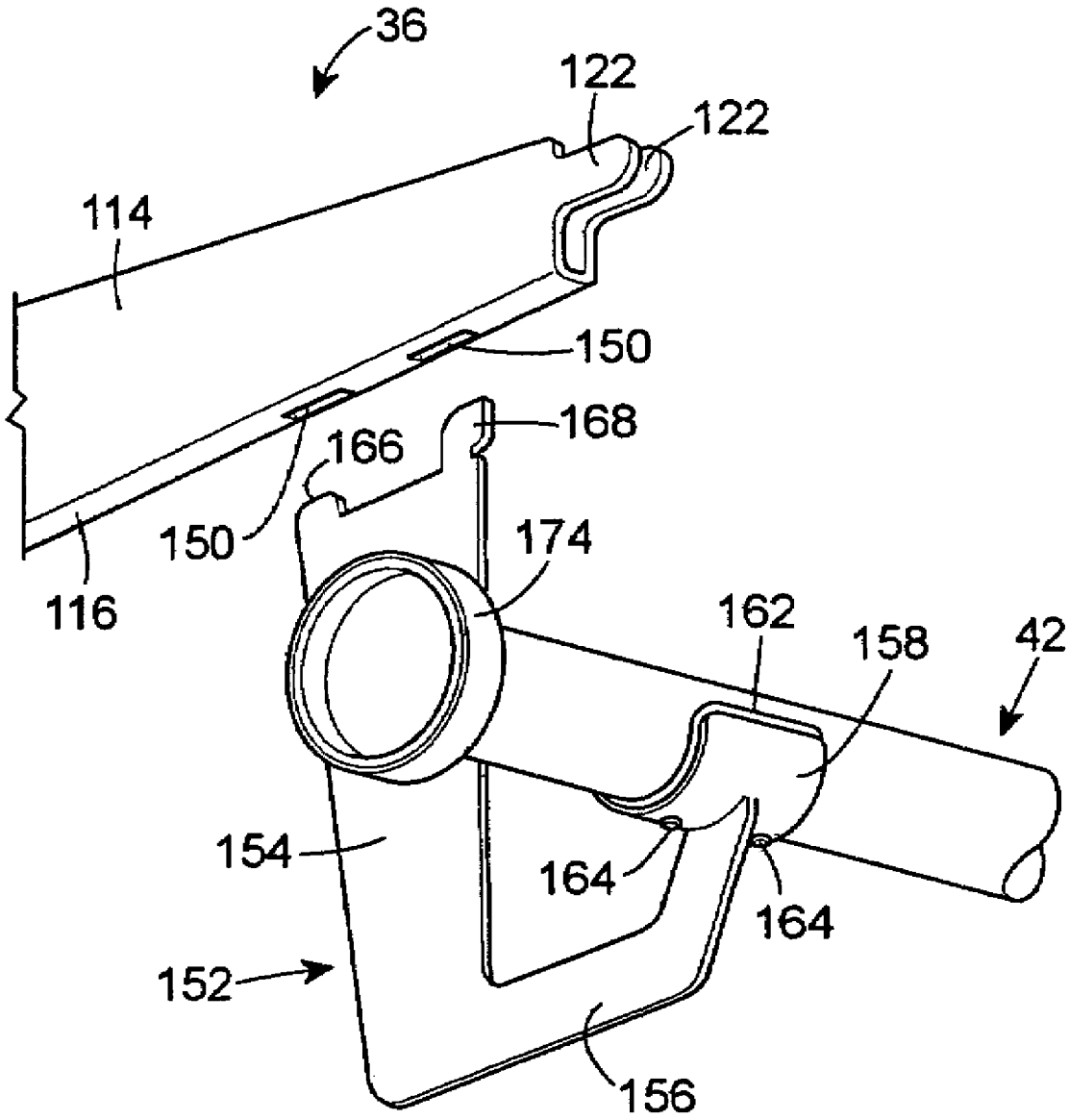
FIG. 14 shows a bottom perspective and partially exploded view of a clothes hanging rod and support bracket accessory for the organizer system shown in FIG. 1 and constructed in accordance with the teachings of the present invention.

As illustrated in FIGS. 1, 2, and 14, one example of an accessory that can be optionally added to the disclosed organizer system 30 is a clothes hanging rod 42. In one example, the shelf mounting brackets 36 or 380 are provided with a pair of slots 150 in the bottom surface 116 or 384. The slots 150 in this example are oriented in a longitudinal direction and spaced apart from one another in the bracket 36 or 380. A rod mounting bracket 152 can be attached to each of the brackets 36 or to any one of the selected brackets as needed.

Figure 15:
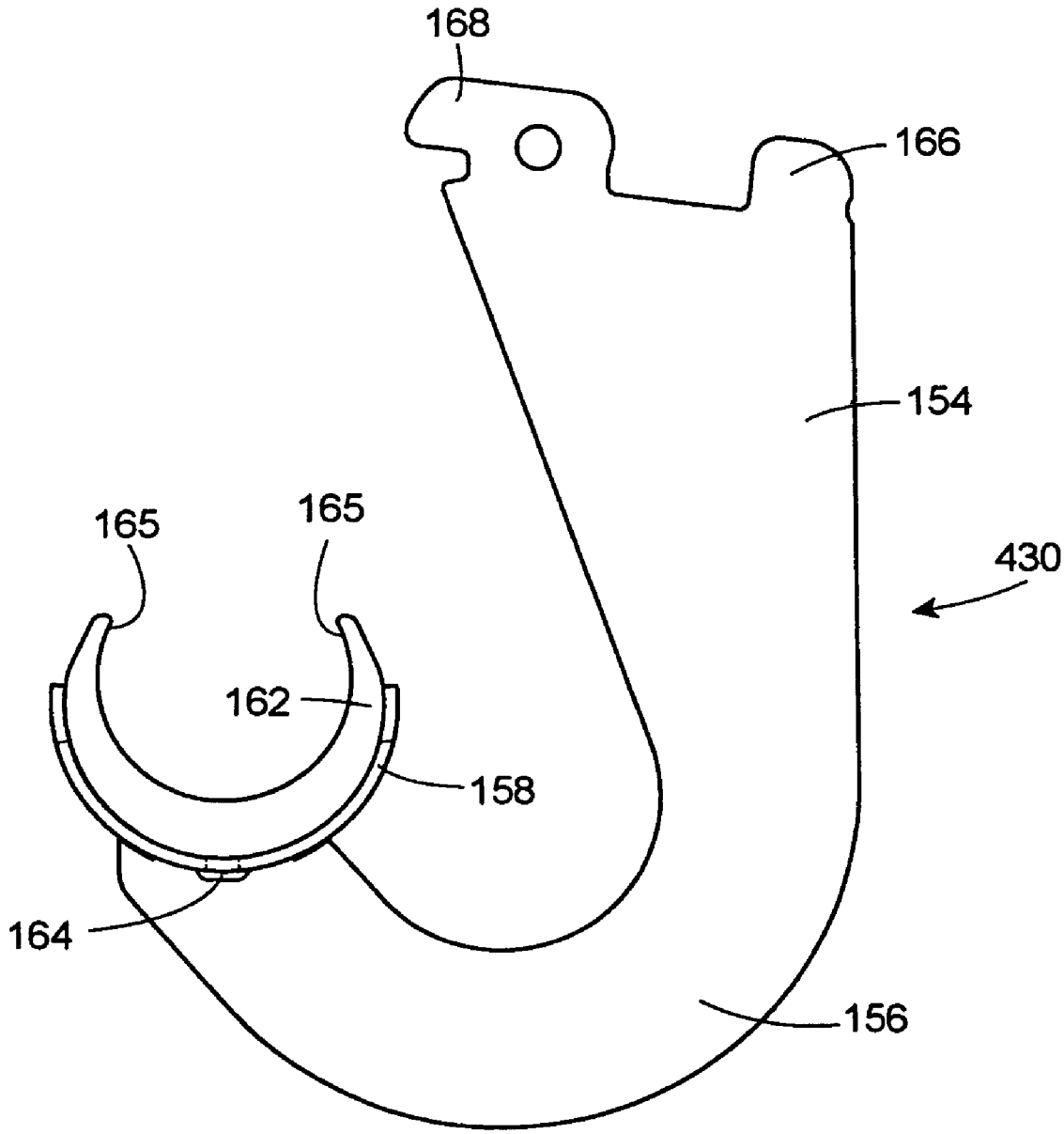
FIG. 15 shows a side view of another example of a clothes hanging rod support bracket.

In this example, the rod support bracket 152 includes a bracket body having a J-shape with an elongate support arm 154 and a lower hook portion 156 that extends from a lower end of the support arm 154 and curves back upwardly in a direction toward the bracket 36 and in a forward direction relative to the bracket 36. A distal end of the curved hook section 156 terminates at a curved, semi-cylindrical receiver 158 that, in the present example, is shaped to conform in shape to a cylindrical clothes hanging rod configuration. The receiver can be integral to or attached, such as by welding, to the hook section 156 as needed. As will be evident to those having ordinary skill in the art, the receiver 158 can take on any number of configurations and constructions, and particularly, it may be best to accommodate the particular shape of a clothes hanging rod. In this example, the rod 42 is a circular cylinder. Thus, the receiver provides a semi-cylindrical surface for supporting the rod. FIG. 15 shows a rod mounting bracket 430, which is only one of many possible alternative shapes for rod mounting bracket accessory. The bracket 430 is also configured for supporting a round rod and has a receiver 158 to accomplish same.

In each example, each receiver is provided with a pair of through holes (shown only in FIG. 15). A soft, flexible bearing insert 162, shown in FIGS. 14 and 15, is provided having a shape that essentially mirrors that of the receiver 150 in this example. A bottom surface of the bearing insert 162 includes a pair of downwardly projecting plugs 164 that are sized to be forceably received through the holes 160 of the receiver to hold and retain the insert in the receiver. The receiver insert 162 is an optional component as well, but can be provided to permit flex in the system and to prevent wear of components bearing on one another. Further, the bearing insert 162 can help to eliminate scraping or surface to surface contact, such as between a metal rod and a metal receiver. If desired, the insert can be configured, as shown in FIG. 15, having an opening 165 that is smaller than the rod diameter. The rod will be snuggly captured in the receiver by the insert to further hold the rod in place, if desired.

An upper end of the support arm has an upwardly projecting tab 166 positioned rearward of an upwardly projecting and forwardly extending L-shaped catch 168. The catch 168 is configured to be received, with the bracket 152 positioned in a forward tilt, in a forward one of the slots 150 in the bottom of the shelf mounting bracket 36. The bracket 152 is then rotated so that the tab 166 is received in the rearward slot 150 in the bracket 36. The rod 42 weight and the geometry of the J-shaped bracket 152 causes the bracket to swing rearward and upward, which retains the rod bracket 152 in its installed orientation.

As illustrated in FIG. 2, for example, a plurality of the J-shaped brackets 152 can be installed from horizontally adjacent and spaced apart mounting brackets 36 in order to support a clothes hanging rod 42 in any location on the organizer system 30 desired. In the example disclosed herein, the clothes hanging rod 42 includes a pair of telescoping segments 170 and 172 so that the clothes rod can also be length adjustable between a length essentially equal to one of the two segments and a length of nearly the entirety of the two segments.

In the disclosed example, the clothes hanging rod segments 170 and 172 are constructed from slightly different diameter hollow tubes that can telescope relative to one another. If needed, the open ends of the hollow tube segments 170 and 172 can be covered by decorative and/or safety end caps 174. The caps can be configured to secure in any known manner. For example, a circular ring can be provided on one end of each cap so that the caps fit snuggly over the exposed ends of the rod segments 170 and 172. A clothes hanging rod 42 accessory can be installed spanning only a single shelf width or multiple shelf widths. Further, multiple rods 42 can be installed at more than one lateral position and/or more than one elevation in an organizer system disclosed herein.

Figure 17:
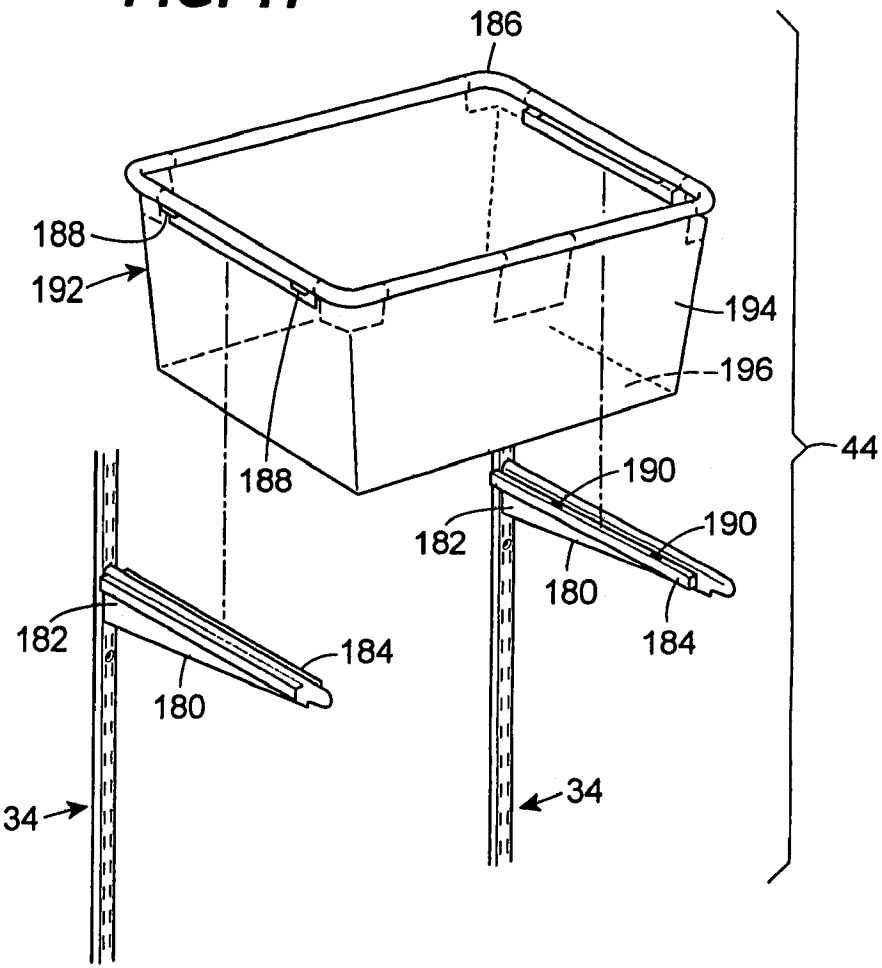
FIG. 17 shows a perspective and partially exploded view of the storage basket accessory as shown in FIG. 16.
Figure 16:
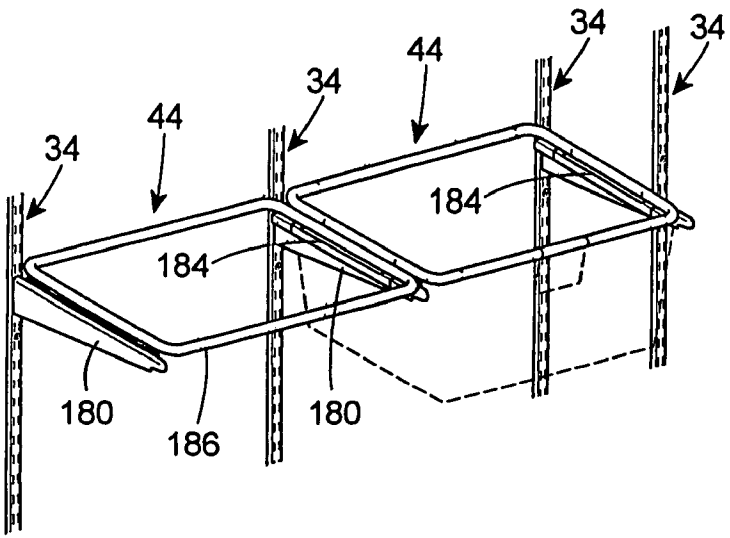
FIG. 16 shows a perspective view of portions of a mounting arrangement for a sliding storage basket accessory of the organizer system shown in FIG. 1 and constructed in accordance with the teachings of the present invention.

As shown in FIGS. 1, 16, and 17, an example of another optional accessory is the storage basket accessory 44. FIGS. 1 and 16 illustrate a pair of adjacent basket accessories 44. Only one will be described herein. In this example, a pair of basket mounting brackets 180 is mounted to adjacent ones of the uprights 34. Though not shown, the brackets 180 include a rear end 182 having vertically spaced apart pairs of attachment hooks constructed, in one example, identically to the hooks 120 and 121 of the shelf brackets 36. The brackets 180 can thus be mounted at any location desired on the uprights.

As an option, each bracket 180 can have a roller-type sliding track 184 attached to an inner side facing the opposed bracket 180. A basket support frame 186 in this example is suspended from or mounted to the slide track 184 of the bracket. In this example, the frame 186 is horizontally oriented and is a rectangular shaped tubular construction. Attachment tabs 188 are provided on the lateral sides of the support frame 186 for being received in slots 190 in the tracks 184. When the frame 186 is pulled forward away from the mounting surface in the direction of the arrows, the tabs 188 stay in the slots 190 and draw the slide track forward making the basket accessory more accessible to the user.

The storage basket accessory 44 also has a basket 192 suspended from the frame 186 in this example. The basket 192 has a perimeter side wall 194 and a bottom wall 196 defining a storage space with depth for storing items. The basket 192 can be made from woven fabric, mesh fabric, flexible plastic, substantially rigid plastic, or any other suitable material. A fabric or flexible basket 192 can include an optional rigid bottom panel (not shown) that sets on the bottom wall to conform and hold a desired shape of the storage space within the basket. No matter the construction, the frame 186 and/or the basket 192 must have a means for suspending the basket from the frame in this example. For a fabric basket, openable flaps can be formed on the upper edges of the basket 192 that can be received and secured over the tube frame. Any suitable means can be used to secure the flaps such as snaps, hook and loop fastener material, zippers, or the like.

As will be evident to those having ordinary skill in the art, the basket 192 and brackets 180 can alternatively be formed as a single integral component that mounts directly to one or more of the uprights. Alternatively, the basket can be formed as a simple structure, either rigid or flexible, that hooks onto or rests on a portion of the one or more simple mounting bars or rods that are suspended from one or more uprights 34. The brackets 180 need not include a slide feature. As a further alterative, the mounting brackets can include a bearing surface over which a mating surface of a basket can slide. Such a basket can be slid along the brackets providing easier access to the storage space, and yet would be simple to manufacture, construct, and use because it would not include separate roller tracks.

Figure 18:
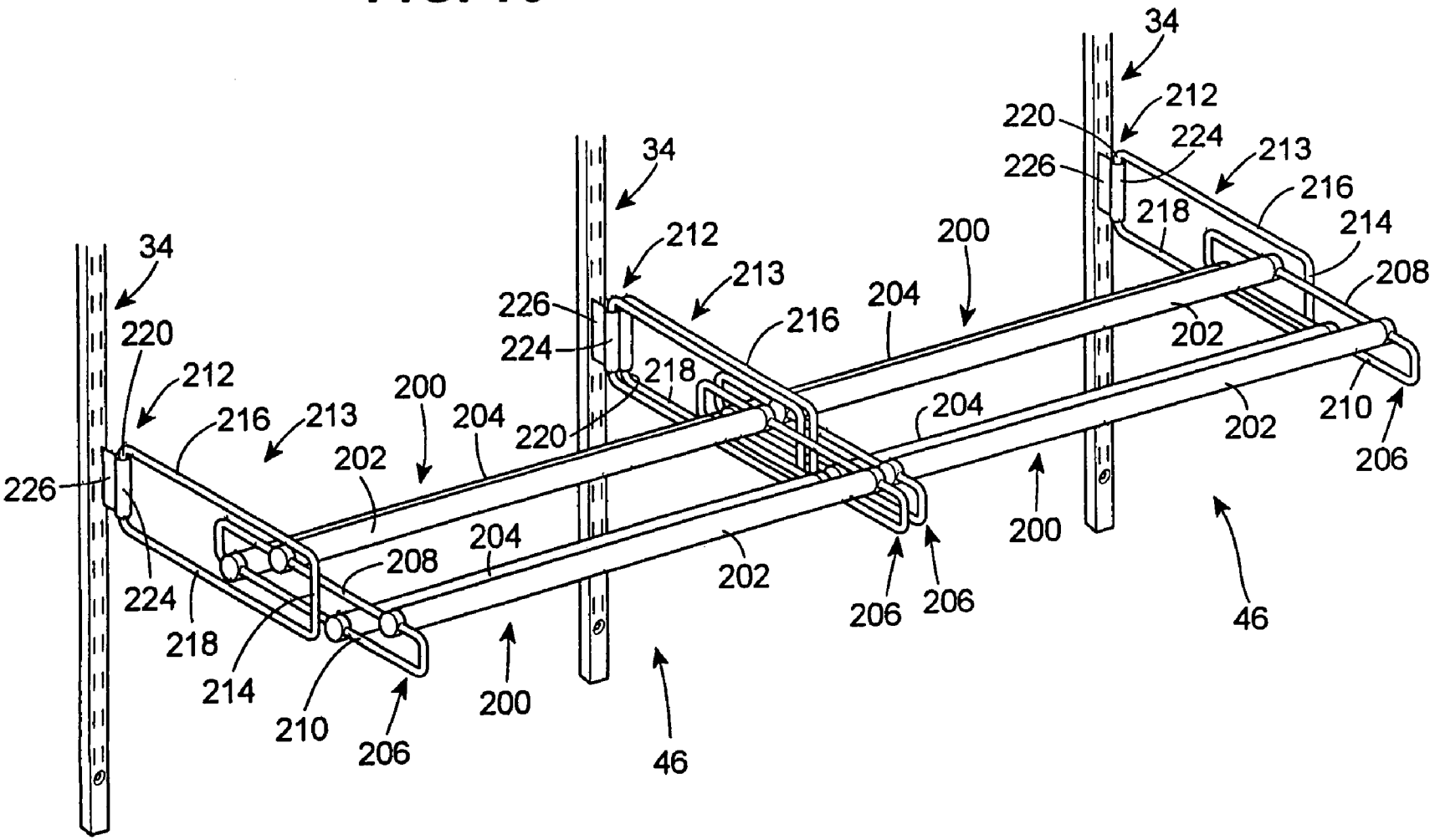
FIG. 18 shows an enlarged perspective view of a shoe rack accessory of the organizer system shown in FIG. 1 and constructed in accordance with the teachings of the present invention.

As shown in FIGS. 1 and 18, an example of another optional accessory is the shoe tube or rack accessory 46. The shoe rack 46 in this example is again illustrated as two adjacent, identical racks. Only one will be described. The shoe rack accessory 46 has a pair of laterally extending shoe supports 200, one spaced rearward of the other. Each shoe support 200 has an upper heel stop bar 202 and a lower sole support bar 204 spaced rearward of and parallel to its corresponding upper heel stop bar. The distal ends of each bar 202 and 204 are secured to opposed sub-frames 206. Each sub-frame 206 is a rectangular shaped wire or tube having an upper rung 208 and a lower rung 210 spaced from the upper rung. The sub-frames are oriented in a vertical plane in this example with the longer dimension along a horizontal axis. The upper heel stop bars 202 are affixed to the upper rung 208 and the lower sole support bars 204 are affixed to the lower rung 210. The bars can be welded to the sub-frames, or can have openings through which the sub-frame is received prior to closing the wire loop.

When a shoe is placed on the rack, the shoe heel should overhang the heel stop bar 202 and the shoe sole should rest on the support bar 204. The position and height difference between the bars 202 and 204 tilt the shoe with the toe downward and toward the system mounting surface.

Each sub-frame 206 is affixed to a mounting bracket 212 which is in turn suspended from an upright 34. The mounting brackets 212 can be any one of many different possible constructions. The brackets 212 illustrate another example of a suitable bracket construction adapted for use with the disclosed organizer system 30. In this example, each bracket 212 has a frame 213 that is a larger rectangular wire tube than the sub-frames. The frames 213 are also oriented in a vertical plane with its long dimension horizontal. Each bracket frame 213 has a front vertical cross bar 214 to which one of the sub-frames is affixed, such as by welding. The cross bar 214 connects forward ends of upper and lower rungs 216, 218 of the bracket frame 213. A rear cross bar 220 connects rearward ends of the rungs 216, 218 to complete the frame 213 loop.

A bracket coupling has a sleeve 224 received over the rear cross bar 220. A plate 226 extends rearward from the sleeve. Though not shown, the plate has a pair of vertically spaced hooks each identical to one of the hooks 120 and 121. The hooks are attached as shown in FIG. 13 to a single row pair of apertures 78 in an upright 34 for mounting the bracket 212. Each bracket 212 and sub-frame 206 is identically mounted and constructed for each rack 46. As with the basket accessory 44, each rack 46 can be mounted to the uprights at any desired location along the uprights 34.

Figure 19A:
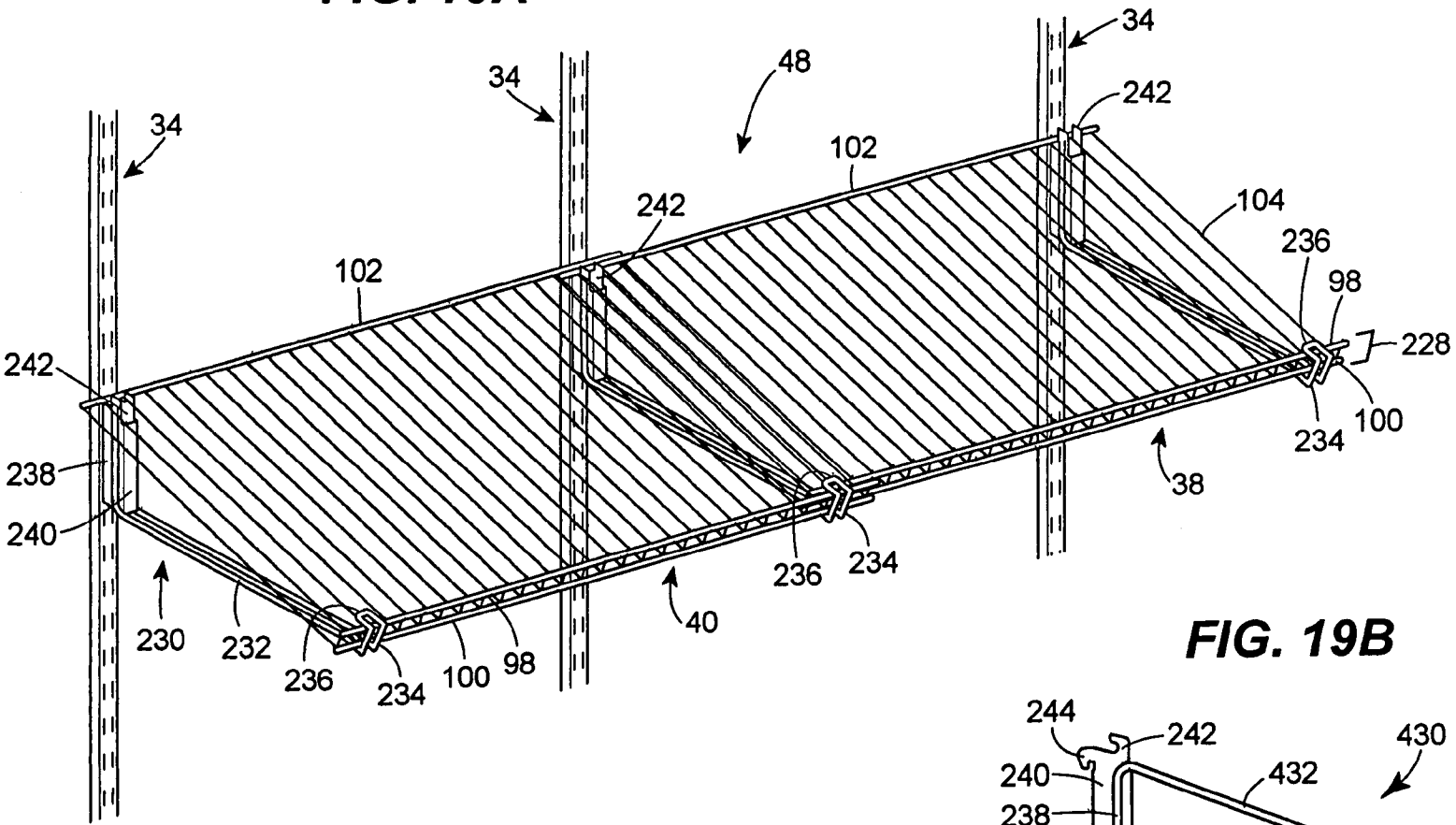
FIG. 19A shows an enlarged perspective view of a shoe shelf accessory of the organizer system shown in FIG. 1 and constructed in accordance with the teachings of the present invention.
Figure 19B:
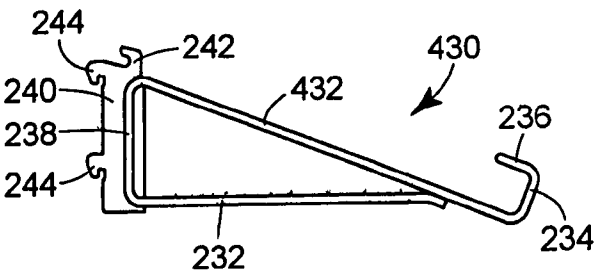
FIG. 19B shows a side and exploded view of a shoe shelf mounting bracket and an inverted shelf as shown in FIG. 19A.
Figure 20B:
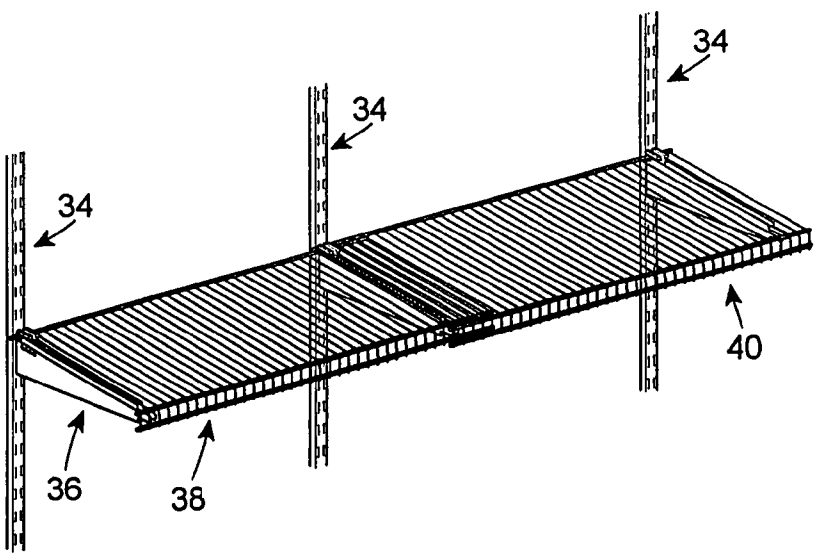
FIGS. 20A and 20B show at least two of many possible shelf arrangements for the organizer system shown in FIG. 1.
Figure 20A:
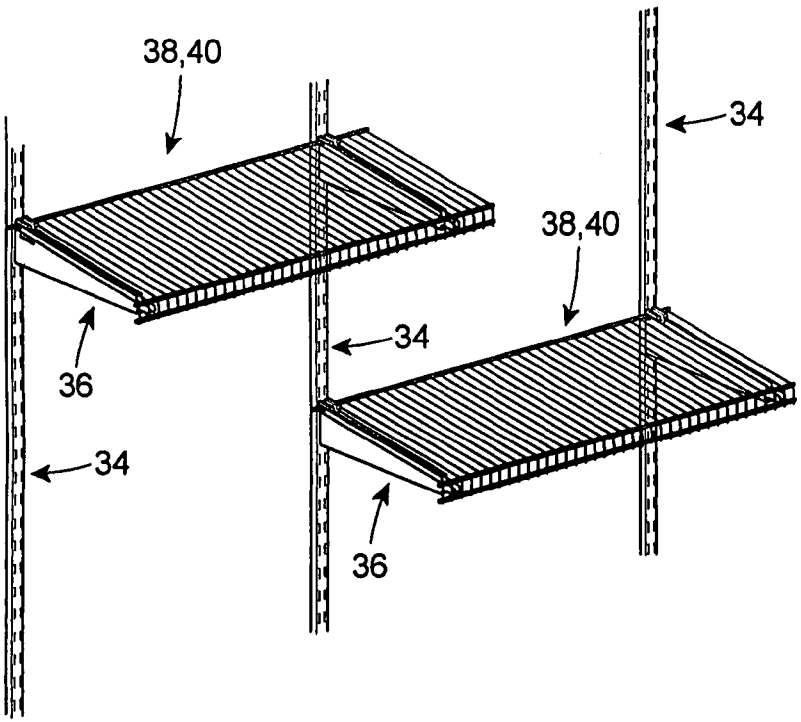
Figure 21A:
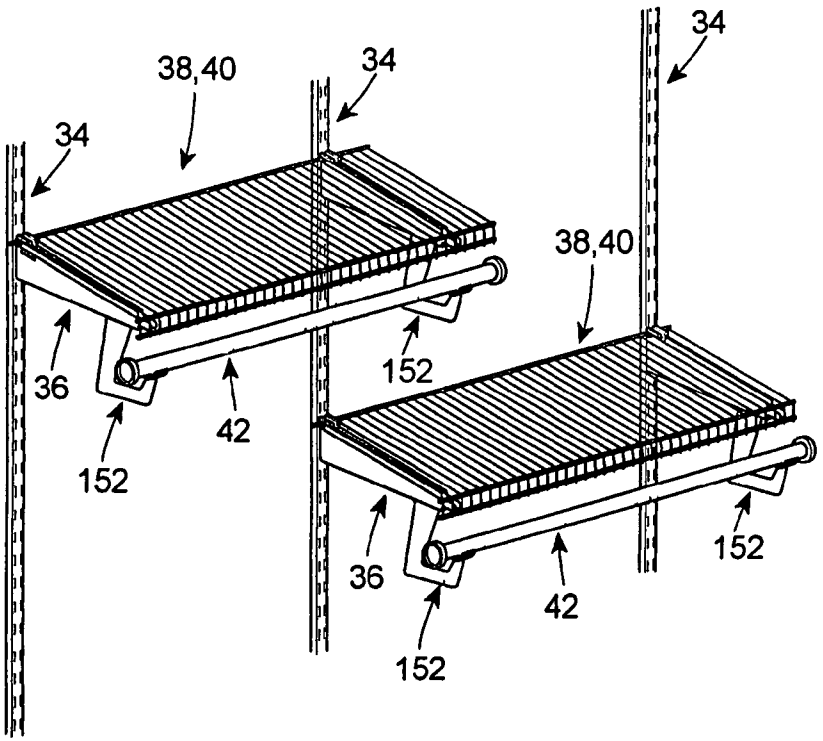
FIGS. 21A and 21B show two of many different shelf and clothes hanging rod arrangements for the organizer system shown in FIG. 1.
Figure 21B:
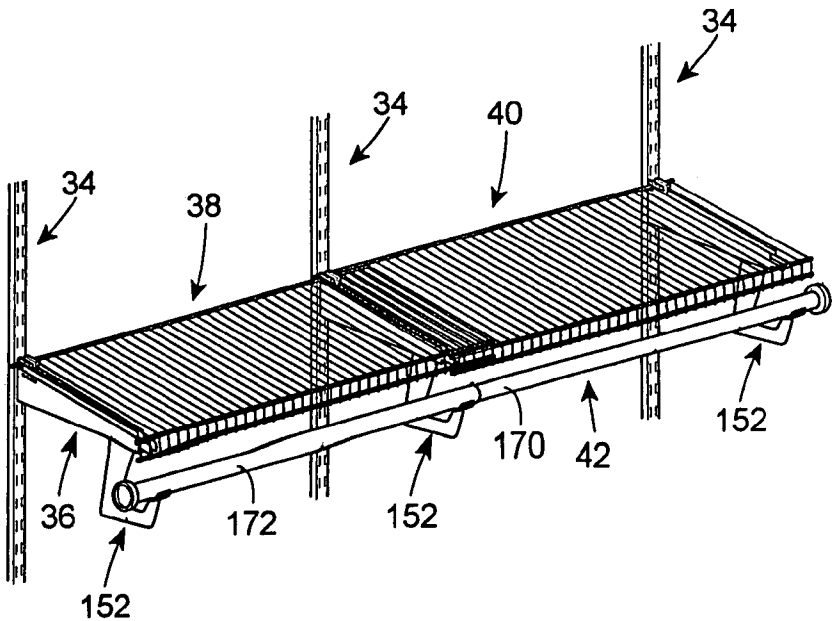

As shown in FIGS. 1, 19A, and 19B, an example of another optional accessory is the shoe shelf accessory 48. FIGS. 1 and 19A illustrate that, in this example, the shoe shelf 46 includes one of each of the shelves 38 and 40 utilized in an inverted and overlapped arrangement. The front ends and rear ends are in the same general position, but the shelf is inverted such that each forward wire 98 is positioned above the respective forward wire 100. The bent portions of the transverse wires 104 now extend upward and in combination with the wire 98 define a shoe barrier 228 in this example.

The shelf is supported in this example by a plurality of shoe shelf brackets 230. Each bracket supports the rear end of the shelf at a higher elevation than the forward end. Thus, shoes stored on the shelf will be tilted toward a user and easily visible and accessible. However, the shoe barrier 228 prevents the shoes from sliding off of the shelf.

Each bracket 230 is shown in FIG. 19A and a modified bracket 430 is shown in FIG. 19B. Each bracket 230, 430 in this example, has a wire formed support 232 with a forward end 234 that is upturned at an angle that corresponds to the tilt angle of the barrier 228. A turned back tip or retainer flange 236 extends from the end of the upturned end 234 and captures the barrier portion of the shelf. The support 232 has a vertical wire connector 238 hung from or coupled to a bracket coupling 240 that is attached to an upright 34. A shelf catch 242 extends upward from the coupling 240 and is spaced away from the front surface of the upright 34 creating a space. The rear shelf wire 102 is captured between the catch 242 and the upright on top of the coupling to support the rear end of the shelf. Again, the coupling 240, shown in FIG. 19B, has appropriate mounting hooks 244 for mounting the coupling and bracket to an upright 34. FIG. 19A illustrates a pair of overlapped shelves 38 and 40 to illustrate that the shoe shelf accessory 46 is also adjustable in width as needed. The bracket 430 has an optional inclined bar 432 extending from the coupling 240 to the upturned end 234, which assists to support the bracket and shelf. Shelf support surfaces are formed at the catch 242 and upturned end 234.

Returning to FIG. 1, yet another example of an optional accessory is the vertical slider accessory 50. In this example, the vertical slider 50 has a pair of elongate brackets 250 mounted and spaced vertically apart along the same upright 34. Each bracket 250 again has hooks, though not shown, for suspending them from the upright. A vertical tubular frame 252 is configured in this example in a rectangle shape is suspended between the pair of brackets 250. The frame 252 can be attached to the brackets 250 in any suitable manner. A fabric or mesh material 254 with storage receptacles 256 is suspended from the frame 252 within the frame interior space.

Though not shown herein, the brackets 250 can alternatively include slide tracks to permit the vertical accessory to be slid outward away from the mounting surface for easy access to the receptacles. Further, the storage receptacles can be replaced by a myriad of other storage options suspended from the accessory frame and/or brackets. The depicted accessory is only one of many possible arrangements. The vertical slider could be adapted to store books, magazines, ties, pants, tools, or many other types of objects as desired.

FIGS. 20A-21B are provided to depict only a few of many different arrangements and configurations that can be achieved by the disclosed organizer system. The arrangement of shelves can be side by side or staggered. The clothes rod accessory 42 can be mounted to side by side shelves, staggered shelves, or only a single shelf. The organizer system and components are highly versatile, easily adjustable and re-adjustable either before, during, or even after installation of the basic mounting components.

Although certain organizer systems and methods have been disclosed and described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A height adjustable upright for an adjustable organizer system, the upright comprising:

a first segment having an upper end configured to hang from a mounting rail and a lower end;

a second segment having an upper end and a lower end;

a clip including a body, a pair of opposed ends, and a bearing plate, one of the opposed ends configured to connect to the lower end of the first segment and the other opposed end configured to connect to the upper end of the second segment to hang the second segment from the first segment, wherein each of the opposed ends includes a protrusion having a first section extending away from a plane of the body and a second section extending from the first section substantially parallel to the plane of the body, the protrusion of one of the opposed ends of the clip configured to engage a cutout in the lower end of the first segment and the protrusion of the other of the opposed ends of the clip configured to engage the upper end of the second segment, wherein the bearing plate extends from an edge of and perpendicular to the plane of the body and is configured to abut an outer surface of both the lower end of the first segment and the upper end of the second segment.

2. A height adjustable upright according to claim 1, wherein the first segment and the second segment are each a U-shaped channel with a front surface, a pair of rearwardly extending side surfaces, and an open back side.

3. A height adjustable upright according to claim 2, wherein the cutout is a non-linear cutout in each side surface adjacent the lower end of the first segment and the one end of the second segment, each cutout forming a notch extending toward the adjacent segment end; and wherein the protrusions are a pair of identically curved hooks, one each extending from one of the opposed ends of the clip, each hook being sufficiently wide to be received in the notches on both side surfaces of the adjacent segment end when the clip is positioned covering the open back side of the corresponding segment.

4. A height adjustable upright according to claim 1, further comprising:

a plurality of the second segments, each having an identical pair of opposed ends connectable end-to-end with a selected one of both the lower end of the first segment and either one of the opposed ends of each second segment.

5. A height adjustable upright according to claim 4, wherein the plurality of second segments include at least two segments of different height between their respective ends.

6. A height adjustable upright according to claim 1, wherein the first sections of the protrusions on the opposed ends of the clip are configured to engage the cutout.

7. A height adjustable upright according to claim 6, wherein an outer edge of the first sections of the protrusions is configured to abut an edge defining the cutout.

8. A height adjustable upright according to claim 1, wherein the first segment and the second segment are different in height between their respective ends.

9. A height adjustable upright according to claim 1, wherein the other end of the second segment is configured to hang from the mounting rail.

10. A height adjustable upright according to claim 1, further comprising:

a fastener opening provided through the lower end of the first segment, through at least the one end of the second segment, and through each end of the clip, the fastener openings in the clip being aligned with one of the fastener openings in the first segment and the second segment when assembled.

11. A height adjustable upright according to claim 1, wherein the opposed ends of the clip body are substantially identical.

12. An adjustable vertical upright kit for an organizer system, the kit comprising:

a plurality of upright first segments each having a plurality, of sides that define an elongate channel within the first segments, a cutout, an upper end and a lower end, the upper ends configured to hang the first segments from a support rail;

a plurality of second segments each having a plurality of sides that define an elongate channel within the second segments, a cutout, an upper and a lower end, the upper ends configured to hang the second segments from a support rail, each of the lower ends of the first and second segments configured to connect end-to-end with the lower end of any other of the first and second segments; and a plurality of clips attachable to the lower ends of the first and the second segments, each clip configured to connect end-to-end adjacent segment lower ends, one hanging from the other, wherein the clip includes a body disposed outside the channels and a protrusion extending through the cutout and into the channel when the clip is attached to at least one of a lower ends of the first and second segments, wherein the clip body includes opposed curved ends, a generally planar section between the opposed ends, and a bearing plate extending from an edge of the body perpendicular to a plane of the body.

13. An adjustable vertical upright apparatus according to claim 12, wherein the protrusions include a first section extending substantially perpendicular from and to a plane of the body and a second section extending from the first section substantially parallel to the body.

14. An adjustable vertical upright apparatus according to claim 12, wherein each of the plurality of first segments is shorter in height than each of the plurality of second segments.

15. An adjustable vertical upright apparatus according to claim 12, wherein the body includes substantially identical opposed ends.

16. An adjustable upright kit for a wall mounted organizer system, the kit comprising:

a plurality of first segments each formed as a channel with a front surface, an open back, and opposed side surfaces, each first segment having a first end with a first notch formed in each of the side surfaces of the first segment adjacent the first end, the first notches positioned across from one another;

a plurality of second segments formed as a channel with a front surface, an open back, and opposed side surfaces, each second segment having a second end longitudinally aligned with the first upright and the second end abutting the first end, each second end having a second notch formed in each of the side surfaces of the second upright segment adjacent the second end, the second notches positioned across from one another;

a plurality of clips each having a body and first and second hooks on opposite ends of the body, the hook ends each configured to hook into the first and second notches, respectively, to connect first and second ends, first and first ends, and second and second ends as desired to hang one of the first or second upright segments from another first or second segment, wherein each of the plurality of first and second segments includes a recess disposed in at least one of the opposed side surfaces for receiving the body of the clip.

17. An adjustable upright kit according to claim 16, wherein each of the clips hooks onto connected segments and extends between the connected segments covering the open backs thereof.

18. A height adjustable upright for an adjustable organizer system, the upright comprising:

a first segment having a first end, a second end, and a plurality of cutouts;

a second segment having a first end, a second end, and a plurality of cutouts; and a clip including a body, opposing first and second hook portions, and a side plate, the first hook portion configured to be disposed in at least one of the plurality of cutouts in the second end of the first segment and the second hook portion configured to be disposed in at least one of the plurality of cutouts in the first end of the second segment to hang the second segment from the first segment, and wherein the side plate extends at an angle from an edge of the body and is disposed outside of both the second end of the first segment and the first end of the second segment.

19. The height adjustable upright according to claim 18, wherein the first and second hook portions of the clip each comprise:

a first portion extending substantially perpendicularly away from the body of the clip; and a second portion extending at an angle away from the first portion.

* * * * *